US012588718B1

(12) United States Patent
Thomas

(10) Patent No.: US 12,588,718 B1
(45) Date of Patent: Mar. 31, 2026

(54) PORTABLE PERSONAL COOLING SYSTEM

(71) Applicant: Sean Thomas, McKinney, TX (US)

(72) Inventor: Sean Thomas, McKinney, TX (US)

(73) Assignee: AFTER HOURS DESIGN LLC, McKKnney, TX (US)

( * ) Notice: Subject to any disclaimer, the term of this patent is extended or adjusted under 35 U.S.C. 154(b) by 0 days.

(21) Appl. No.: 19/252,316

(22) Filed: Jun. 27, 2025

Related U.S. Application Data

(60) Provisional application No. 63/733,402, filed on Dec. 12, 2024.

(51) Int. Cl.
*A41D 13/005* (2006.01)
*A41D 1/04* (2006.01)
*A41D 13/002* (2006.01)

(52) U.S. Cl.
CPC ..... *A41D 13/0053* (2013.01); *A41D 1/04* (2013.01); *A41D 13/0025* (2013.01); *A41D 13/0058* (2013.01)

(58) Field of Classification Search
CPC .... A41D 13/0053; A41D 1/04; A41D 13/002; A41D 13/0058
See application file for complete search history.

(56) References Cited

U.S. PATENT DOCUMENTS 4,998,415 A * 3/1991 Larsen ..... A61F 7/10 62/259.3
5,415,222 A * 5/1995 Colvin ..... F28D 20/02 165/902
5,564,124 A 10/1996 Elsherif et al.
5,606,746 A 3/1997 Shelton et al.
6,227,004 B1 5/2001 Gerstein
6,230,501 B1 * 5/2001 Bailey, Sr. ..... B60N 2/5685 62/51.1
6,571,568 B1 6/2003 Link
6,931,875 B1 8/2005 Allen et al.
(Continued)

FOREIGN PATENT DOCUMENTS

CN 210696047 6/2020
CN 216393111 4/2022
(Continued)

OTHER PUBLICATIONS

Alphacool 12 V Motorcycle Circulatory Cooling Vest, from Alphacool Store on Amazon.com, available at "https://www.amazon.com/dp/B098GV5Z92/", date first available according to Amazon site Jul. 1, 2021.

(Continued)

*Primary Examiner* — Tajash D Patel

(57) ABSTRACT

A cooling system, such as a cooling vest, includes a cooling panel having a cooling panel body having a front wall, a rear wall, and an interior space between the front wall and the rear wall. A cooling member is positionable within the interior space of the cooling panel body, such as by being removably insertable thereinto. The cooling panel includes a conduction surface adapted to directly or indirectly contact an individual, such as a wearer, wherein the conduction surface is cooled by the cooling member in the interior space. Optionally, a fan can blow air chilled by the cooling member towards the individual so the individual can also experience convection cooling.

22 Claims, 21 Drawing Sheets

(56) References Cited

U.S. PATENT DOCUMENTS

| | | | | |
|---|---|---|---|---|
| 7,246,505 | B2 | 7/2007 | Nave do | |
| D599,529 | S | 9/2009 | Simpson | |
| 7,603,875 | B2 | 10/2009 | Carr | |
| 7,739,748 | B2 | 6/2010 | Nilforushan et al. | |
| 7,748,235 | B1 | 7/2010 | Franklin et al. | |
| 7,814,764 | B1 | 10/2010 | Heater et al. | |
| 7,827,624 | B1 * | 11/2010 | Cole | A41D 13/0053 2/458 |
| 8,281,609 | B1 * | 10/2012 | Rothschild | A41D 13/0053 62/259.3 |
| 8,434,163 | B1 | 5/2013 | Nudo | |
| 8,544,115 | B1 * | 10/2013 | Gravenstein | A41D 13/005 2/81 |
| 9,091,449 | B2 | 7/2015 | Donaldson et al. | |
| 9,980,526 | B2 | 5/2018 | Silverberg | |
| 11,026,834 | B2 | 6/2021 | Cesaroni | |
| 11,330,852 | B2 | 5/2022 | Luo | |
| 11,684,094 | B2 | 6/2023 | Arnold et al. | |
| 2004/0159109 | A1 | 8/2004 | Harvie | |
| 2004/0168459 | A1 * | 9/2004 | Blackstone | B60H 1/3235 2/DIG. 1 |
| 2005/0223465 | A1 | 10/2005 | Williams et al. | |
| 2006/0174392 | A1 * | 8/2006 | Farnworth | A62B 17/005 2/102 |
| 2011/0030413 | A1 | 2/2011 | Heil | |
| 2012/0036623 | A1 * | 2/2012 | Minogue | A41D 13/0158 2/463 |
| 2014/0157484 | A1 | 6/2014 | Ezell | |
| 2015/0374045 | A1 * | 12/2015 | Codner | A61F 7/02 2/455 |
| 2017/0340036 | A1 * | 11/2017 | Squires | A41D 13/0025 |
| 2023/0157382 | A1 * | 5/2023 | Ichigaya | A41D 3/02 2/69 |
| 2025/0161725 | A1 * | 5/2025 | Carrocia | A62B 35/0025 |

FOREIGN PATENT DOCUMENTS

| | | | | |
|---|---|---|---|---|
| KR | 101093495 | | 12/2011 | |
| KR | 102077403 | B1 * | 2/2020 | A41D 13/0053 |
| KR | 20210114615 | A * | 9/2021 | A41D 13/0053 |
| KR | 20210131719 | A * | 11/2021 | F25D 3/14 |
| WO | WO 2015/011673 | | 1/2015 | |
| WO | WO-2017048198 | A1 * | 3/2017 | A41D 31/14 |

OTHER PUBLICATIONS

Flexifreeze Personal Cooling Ice Vest, by Maranda Enterprises, available at "https://flexifreeze.com/products/flexifreeze-personal-cooling-ice-vest", earliest publication date unknown, prior to Dec. 2024.

Venture Heat 5V . . . Cooling Fan Vest, by Venture Heat, "https://www.ventureheat.com/collections/all/products/venture-heat-5v-1-speed-wearable-cooling-cooling-fan-vest?variant=46600225751265", earliest publication date unknown, prior to Dec. 2024.

Logos Outdoor Electric Body Air Conditioner, by Logos, available at "https://www.japantrendshop.com/logos-outdoor-electric-body-air-conditioner-p-7380.html?a_aid=7aaad3d9", earliest publication date unknown, prior to Dec. 2024.

Icybreezeultimate, available at "https://www.icybreeze.com/ultimate", earliest publication date unknown, prior to Dec. 2024.

Icybreeze Platinum Pro, available at "https://www.icybreeze.com/platinum-pro/", earliest publication date unknown, prior to Dec. 2024.

Icybreeze V2 Pro, available at "https://www.icybreeze.com/V2pro/", earliest publication date unknown, prior to Dec. 2024.

Zero Breeze Mark 2 AC, available at "https://zerobreeze.com/products/zero-breeze-2", earliest publication date unknown, prior to Dec. 2024.

Arctic Air Pure Chill 2.0, available at https://www.arcticairpurechill.com, earliest publication date unknown, prior to Dec. 2024.

Portable Aircraft Air Conditioner from Hamilton Motor Company, available at "https://www.hamiltonmotorcompany.com/products/portableaircraftac", earliest publication date unknown, prior to Dec. 2024.

Homemade Air Conditioner from Autodesk Instructables, available at "https://www.instructables.com/homemade-air-conditioner/", earliest publication date unknown, prior to Dec. 2024.

Thanko Reizofuku 2 Cooling Vest, by Thanko, available at "https://www.japantrendshop.com/thanko-reizofuku-2-cooling-vest-p-8319.html", earliest publication date unknown, prior to Dec. 2024.

Hyperwear Coolover Advanced Cooling Vest, by Hyperware, available at "https://hyperwear.com/products/coolover-advanced-cooling-vest", earliest publication date unknown, prior to Dec. 2024.

Qore Performance Iceplate Slk Safety Vest with Cooling/Heating Hydration, by QorePerformance, available at "https://www.qoreperformance.com/collections/industrial-safety/products/iceplate-slk", earliest publication date unknown, prior to Dec. 2024.

Flexi Freeze Professional Series Ice Vest Cooling Vest, by Maranda Enterprises, available at "https://flexifreeze.com/collections/personal-cooling/products/personal-cooling-vest-professional-series", earliest publication date unknown, prior to Dec. 2024.

Oro Sports Cooling Vests, by Oro Sports USA, available at "https://www.orosportsusa.com/collections/cooling-vests", earliest publication date unknown, prior to Dec. 2024.

Glacier Tek Sports Cool Vest, by Glacier Tek, available at "https://glaciertek.com/collections/all", earliest publication date unknown, prior to Dec. 2024.

Midian Summer Air Conditioned Cooling Vest, from Midian Store on Amazon.com, available at "https://www.amazon.com/dp/B0D6VKNQ17/", date first available according to Amazon site Jun. 12, 2024.

Alphacool Original Cooling Ice Vest, from Alphacool Store on Amazon.com, available at "https://www.amazon.com/dp/B08B8YSJW7", date first available according to Amazon site Jul. 12, 2020.

Alphacool Frosty Mesh Ice Vest, from Alphacool Store on Amazon.com, available at "https://www.amazon.com/dp/B08CHN5H52", date first available according to Amazon site Jul. 7, 2020.

Tourgo PCM Cooling Vest for MS Patients, from Tourgo PCM Store on Amazon.com, available at "https://www.amazon.com/dp/B0D8SX7HN2", date first available according to Amazon site Jul. 4, 2024.

* cited by examiner

PORTABLE PERSONAL COOLING SYSTEM

PRIORITY

The present application claims the benefit of domestic priority based on U.S. Provisional Patent Application 63/733,402 filed on Dec. 12, 2024, the entirety of which is incorporated herein by reference.

BACKGROUND

Staying cool in warm environments is challenging, especially when in the outdoors or when exercising.

Attempts have been made to provide portable cooling systems in the form of wearable ice vests where ice packs or freezable packets are placed in pockets of the vest so they can cool the wearer. While effective in some limited situations, existing ice vests suffer from one or more disadvantages. For example, the cooling effect is very localized to the specific position of the ice. The ice is very cold to the touch and does not effectively cool the wearer over a sufficiently large area. Vests that include phase change materials, such as the Glacier Tek vest, utilize materials that freeze at temperatures closer to the wearers body temp (i.e. about 59 degrees F.), but they have a much a lower heat storage capacity. For example, typical phase change materials have a heat storage capacity of approximately 200 J/g as opposed to ice which has a heat storage capacity of 333 J/g. Also, because the interface temperature is higher than 59 degrees F. with the Glacier Tek device, there are times when the cooling effect is limited, especially when thick clothing is worn.

Other types of cooling vests involve blowing air. Typically, these devices are merely fans that do not blow chilled air on the wearer and are therefore not very effective in cooling the wearer. Some devices blow air that is chilled by air conditioning systems. However these devices are expensive, heavy, and/or have large power requirements. In addition, these devices cool a very small area and also discharge heat in the process.

Therefore, there is a need for an improved cooling system in the form of a portable personal cooling system. There is further a need for an improved cooling vest. There is a further need for an improved personal cooling system, such as a cooling vest, that cools an individual, such as a wearer, by both conduction cooling and/or convection cooling in an improved manner. There is a further need for a portable personal cooling system, such as a cooling vest, that includes one or more cooling panels that are modular and separately useable.

SUMMARY

The present invention satisfies one or more of these needs. In one aspect of the invention, an improved portable personal cooling system is provided.

In another aspect of the invention, an improved cooling vest is provided.

In another aspect of the invention, a cooling system comprises a cooling panel that can cool an individual by conduction cooling and convection cooling.

In another aspect of the invention, a cooling system in the form of a cooling vest comprises a cooling panel that can cool an individual by conduction cooling and convection cooling.

In another aspect of the invention, a cooling system comprises a cooling panel comprising a fan associated with a cooling panel body that receives a cooling member.

In another aspect of the invention, a cooling system comprises a cooling panel comprising a fan associated with a cooling panel body that receives a cooling member, wherein the fan receives chilled air from the cooling panel body and blows the chilled air towards an individual to be cooled.

In another aspect of the invention, a cooling system comprises a cooling panel comprising a fan associated with a cooling panel body that receives a cooling member, wherein the cooling panel body is adapted to cool an individual by conduction cooling.

In another aspect of the invention, a cooling system comprises a cooling panel comprising a fan associated with a cooling panel body that receives a cooling member, wherein the fan receives chilled air from the cooling panel body and blows the chilled air towards an individual to be cooled, and wherein the cooling panel body is adapted to cool an individual by conduction cooling.

In another aspect of the invention, a cooling system comprises a cooling panel comprising a fan associated with a cooling panel body that receives a cooling member, wherein the cooling member is removable, chillable, and reinsertable into the panel body.

In another aspect of the invention, a cooling system in the form of a cooling vest comprises a supporting system and a cooling panel comprising a fan associated with a cooling panel body that receives a cooling member.

In another aspect of the invention, a cooling system in the form of a cooling vest comprises a supporting system and a cooling panel comprising a fan associated with a cooling panel body that receives a cooling member, wherein the fan receives chilled air from the cooling panel body and blows the chilled air towards an individual to be cooled.

In another aspect of the invention, a cooling system in the form of a cooling vest comprises a supporting system and a cooling panel comprising a fan associated with a cooling panel body that receives a cooling member, wherein the cooling panel body is adapted to cool an individual by conduction cooling.

In another aspect of the invention, a cooling system in the form of a cooling vest comprises a supporting system and a cooling panel comprising a fan associated with a cooling panel body that receives a cooling member, wherein the fan receives chilled air from the cooling panel body and blows the chilled air towards an individual to be cooled, and wherein the cooling panel body is adapted to cool an individual by conduction cooling.

In another aspect of the invention, a cooling system in the form of a cooling vest comprises a supporting system and a cooling panel comprising a fan associated with a cooling panel body that receives a cooling member, wherein the cooling member is removable, chillable, and reinsertable into the panel body.

In another aspect of the invention, a cooling system comprises a supporting system and a plurality of cooling panels that can cool an individual by conduction cooling and/or convection cooling.

In another aspect of the invention, a cooling system in the form of a cooling vest comprises a supporting system and a plurality of cooling panels including a front cooling panel and a rear cooling panel, wherein the cooling panels can cool an individual by conduction cooling and/or convection cooling.

In another aspect of the invention, a cooling system comprises a supporting system and a plurality of cooling panels that can selectively cool an individual by conduction cooling and/or convection cooling.

In another aspect of the invention, a cooling system in the form of a cooling vest comprises a supporting system and a plurality of cooling panels including a front cooling panel and a rear cooling panel, wherein the cooling panels can selectively cool an individual by conduction cooling and/or convection cooling.

In another aspect of the invention, a cooling system in the form of a cooling vest comprises a cooling panel that can cool an individual by conduction cooling in an improved manner, such as by improving the interface temperature between the cooling panel and the individual.

In another aspect of the invention, a cooling system in the form of a cooling vest comprises a cooling panel that can cool an individual by convection cooling in an improved manner, such as by blowing chilled air without the requirement for expensive, weighty, and excessive power consuming equipment.

In another aspect of the invention, a method of cooling an individual comprises providing a portable personal cooling system as described herein and using the portable personal cooling system as described herein.

In another aspect of the invention, a method of cooling an individual comprises a wearable cooling system as described herein and using the wearable cooling system as described herein.

In another aspect of the invention, a method of cooling an individual comprises providing a cooling vest as described herein and using the cooling vest as described herein.

In another aspect of the invention, a cooling system comprises a cooling panel, the cooling panel comprising: a cooling panel body having a front wall, a rear wall, and an interior space between the front wall and the rear wall, a cooling member positionable within the interior space of the cooling panel body, and a fan member positionable on the cooling panel body; and a supporting system adapted to support the cooling panel in proximity to the wearer's front or rear torso, wherein the cooling panel includes a conduction surface adapted to directly or indirectly contact the wearer, wherein the conduction surface is cooled by the cooling member in the interior space, and wherein the fan member can blow air towards the wearer.

In another aspect of the invention, a cooling vest for cooling a wearer comprises a cooling panel, the cooling panel comprising a cooling panel body having a front wall, a rear wall, and an interior space between the front wall and the rear wall, a cooling member positionable within the interior space of the cooling panel body, and a fan member positionable on the cooling panel body; and a supporting system adapted to support the cooling panel in proximity to the wearer's front or rear torso, wherein the cooling panel includes a conduction surface adapted to directly or indirectly contact the wearer, wherein the conduction surface is cooled by the cooling member in the interior space, and wherein the fan member can blow air towards the wearer.

In another aspect of the invention, a cooling vest for cooling a wearer comprises a cooling panel, the cooling panel comprising: a cooling panel body having a front wall, a rear wall, and an interior space between the front wall and the rear wall; a cooling member positionable within the interior space of the cooling panel body; a fan member positionable on the cooling panel body; and a supporting system adapted to support the cooling panel in proximity to the wearer's front or rear torso, wherein the cooling panel includes a conduction surface adapted to directly or indirectly contact the wearer, wherein the conduction surface is cooled by the cooling member in the interior space, wherein the fan member can blow air towards the wearer, and wherein the cooling member is removably insertable into the interior space so that it can be chilled prior to insertion.

In another aspect of the invention, a cooling vest for cooling a wearer comprises a cooling panel, the cooling panel comprising: a cooling panel body having a front wall, a rear wall, and an interior space between the front wall and the rear wall; a cooling member positionable within the interior space of the cooling panel body; a fan member positionable on the cooling panel body; and a supporting system adapted to support the cooling panel in proximity to the wearer's front or rear torso, wherein the cooling panel includes a conduction surface adapted to directly or indirectly contact the wearer, wherein the conduction surface is cooled by the cooling member in the interior space, wherein the fan member can blow air towards the wearer, and wherein the fan member is adapted to blow air chilled by the cooling member in the interior space towards the wearer.

In another aspect of the invention, a cooling vest for cooling a wearer comprises a cooling panel, the cooling panel comprising a cooling panel body having a front wall, a rear wall, and an interior space between the front wall and the rear wall; a cooling member positionable within the interior space of the cooling panel body; a fan member positionable on the cooling panel body; and a supporting system adapted to support the cooling panel in proximity to the wearer's front or rear torso, wherein the cooling panel body comprises a panel air inlet, a panel air outlet, and an airflow pathway between the panel air inlet and the panel air outlet, wherein air in the airflow pathway is chilled by the cooling member in the interior space, and wherein the fan member receives chilled air from the panel air outlet and blows the chilled air towards the wearer.

In another aspect of the invention, a method of cooling a wearer of a cooling vest comprises providing a cooling vest comprising a cooling panel, the cooling panel comprising a cooling panel body having a front wall, a rear wall, and an interior space between the front wall and the rear wall; providing a cooling member in the interior space of the cooling panel body; positioning a fan member on the cooling panel body; supporting the cooling panel in proximity to the wearer's front or rear torso; cooling a conduction surface of the cooling panel body with the cooling member; directly or indirectly contacting the wearer with the conduction surface of the cooling panel body to cool the wearer by conduction cooling; and blowing chilled air towards the wearer from the fan member to cool the wearer by convection cooling.

BRIEF DESCRIPTION OF THE DRAWINGS

These features, aspects, and advantages of the present invention will become better understood with regard to the following description, appended claims, and accompanying drawings which illustrate exemplary features of the invention. However, it is to be understood that each of the features can be used in the invention in general, not merely in the context of the particular drawings, and the invention includes any combination of these features, where:

DESCRIPTION

The present invention relates to a portable personal cooling system. In particular, the invention relates to a wearable portable personal cooling system. Although the invention is illustrated and described in the context of being useful as a vest or the like, the present invention can be used in other ways, as would be readily apparent to those of ordinary skill in the art. Accordingly, the present invention should not be limited just to the examples and embodiments described herein.

Figure 1:
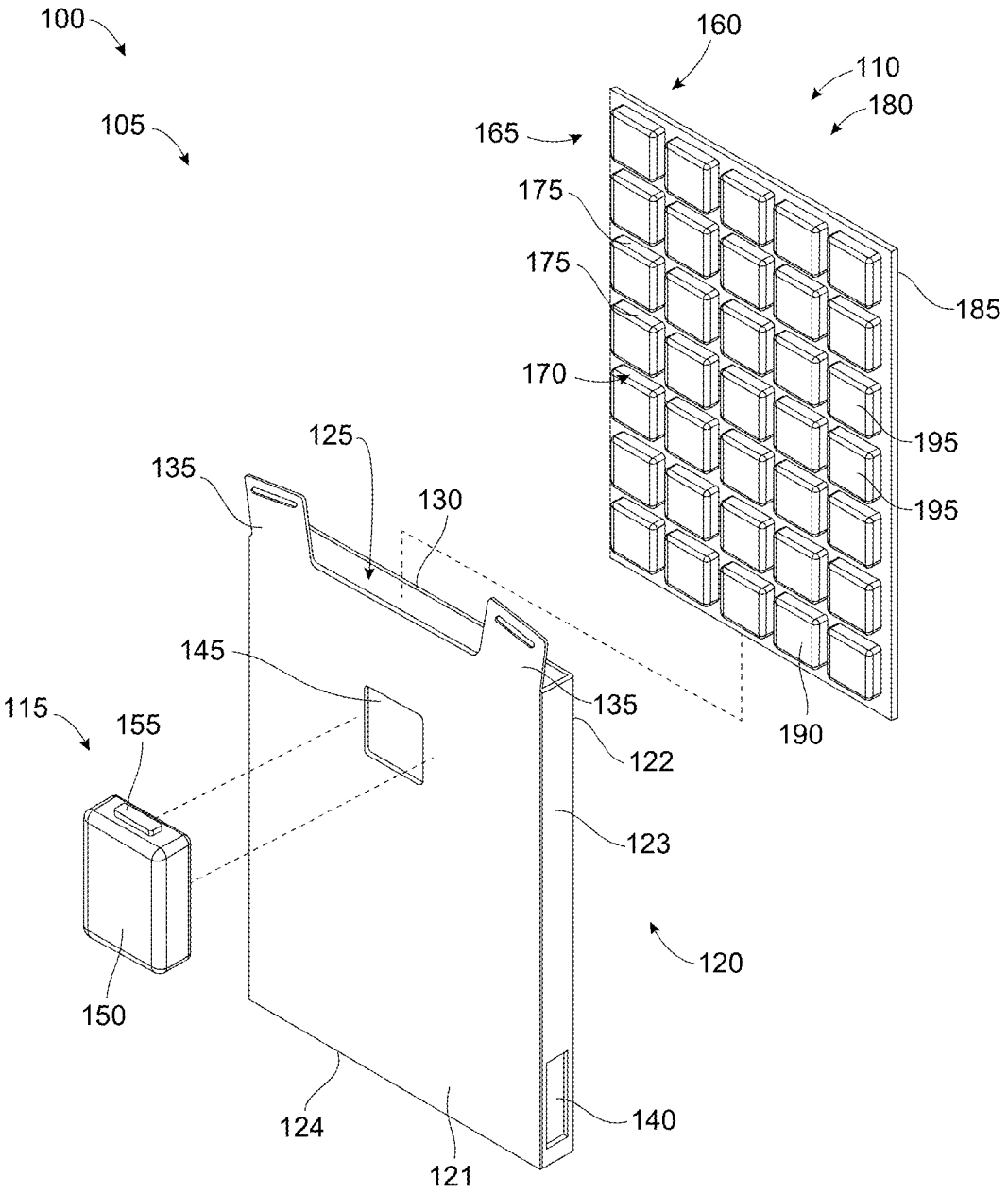
FIG. 1 is a schematic front perspective exploded view of a version of a cooling system according to the invention.

FIG. 1 shows a version of a cooling system 100 of the present invention. The cooling system 100 is designed to be portable and/or personal and is adapted or adaptable for use in a variety of situations, such as by being wearable by an individual and/or otherwise holdable or positionable in proximity to an individual, to help cool the individual. The cooling system 100 of the invention comprises one or more cooling panels 105 and optionally any attachments and/or structures that are useful in positioning the cooling panel in relation to an individual to be cooled. The cooling panel 105 comprises a cooling member 110 and a fan member 115 that are each associated with a cooling panel body 120. For example, the cooling member 110 can be insertable into the cooling panel body 120, and the fan member 115 can be connected or connectable to the cooling panel body 120. The cooling system 100 is thus designed to cool an individual by conduction, convection, or a combination of conduction and convection, as will be described. As used herein, by conduction it is meant cooling by the transfer of heat between two objects that are in contact with one another, such as a surface of the cooling panel and an individual or the individual's clothing or other intermediate member, and by convection it is meant cooling by heat transfer caused by the movement of cool air in proximity to an individual. The cooling effect provided by convection can be a result of the transfer of heat away from the individual in accordance with the laws of thermodynamics and/or from the effects of the facilitation of evaporative cooling when the individual is sweaty or otherwise wet.

The cooling panel 105 is adapted to cool an individual by conduction when the cooling panel body 120 comes into contact directly or indirectly with the individual. The cooling panel body 120 has a front wall 121, a rear wall 122, a side wall 123, and a bottom wall 124 that together define an interior space 125 of the cooling panel body 120. A second side wall 123 is located on the opposite side. Optionally, the front wall 121 and the rear wall 122 can be directly connected to one another so that the side wall 123 and/or the bottom wall 124 may be made up of only the connection region. An opening 130 in the cooling panel body 120 provides access to the interior space 125. In the version shown, the opening 130 is in a top region of the cooling panel body 120 but can alternatively be located at a different position, such as on a side wall 123, of the cooling panel body 120. The cooling panel body 120 may also include one or more attachment members 135 for an attachment mechanism to facilitate the attachment of the cooling panel 105 to an individual or other object. An attachment member 135 can be any structural feature on the cooling panel body 120 that allows the cooling panel body 120 to be attached, connected to, or be useful with another structure. When the cooling member 110 is received within the interior space, the cooling member 110 cools the cooling panel body 120, and the cooled cooling panel body 120 can then cool another object by the transfer of heat away from the object it is contacting by the process of conduction, as will be described in more detail hereinbelow.

The cooling panel 105 is also capable of cooling an individual by the process of convection by blowing cool air in the direction of the individual. The cooling panel body 120 includes one or more panel air inlets 140 and one or more panel air outlets 145. In the version of FIG. 1, a panel air inlet 140 is provided on a lower portion of one or both side walls 123, and a panel air outlet 145 is provided on the front wall 121. The positions of the panel air inlet 140 and panel air outlet 145 can be altered, as needed, as will be discussed. The fan member 115 is positionable on the front wall 121 of the cooling panel body 120 so that it is in flow communication with the panel air outlet 145. The fan member 115 and panel air outlet 145 may alternatively be positioned on a different surface of the cooling panel body 120. The fan member 115 comprises a fan housing 150 having a fan air inlet that faces and/or matingly engaged the panel air outlet 145, a fan air outlet 155, and an internal air passageway extending from the fan air inlet to the fan air outlet 155. Within the internal air passageway, a fan is positioned to draw air from the panel air outlet 145 into the fan air inlet and blow air out of the fan air outlet 155 in a direction where the blown air is directed towards an individual to be cooled. The fan member 115 includes a power supply that powers the operation of the fan. In one version, the power supply comprises one or more batteries, which may be rechargeable and/or solar powered, or the like. One or more control buttons are provided on the fan member 115 to control operation of the fan, such as by turning the fan on and off and/or controlling the speed of the fan, in conventional manner.

As can be seen in version of FIG. 1, the cooling member 110 includes a rear facing side 160 and a front facing side 165. The front facing side includes an airflow channeling system 170 designed and configured to chill air flowing from the panel air inlet 140 to the panel air outlet 145. The airflow channeling system 170 comprises one or more airflow channels 175 sized and shaped to allow air to flow therethrough and/or there along. The airflow channels 175 not only direct the flow of air from the panel air inlet 140 to the panel air outlet 145, the airflow channels 175 also serve to increase the heat transfer so that the air flowing from the panel air inlet 140 to the panel air outlet 145 is cooler than it would be in the absence of the one or more airflow channels 175 where air flows unobstructed from the panel air inlet 140 to the panel air outlet 145. For example, the one or more airflow channels 175 can cause the air flowing to be thinned, constricted, turbulent, bent, or otherwise disturbed and/or to flow across a greater surface area or contact area of chilled surface than if the entire chilled surface was flat, such as when the flow is through a channel made up of multiple walls that are each chilled.

In the specific version shown in FIG. 1, the cooling member 110 is made up of one or more cooling sheets 180 sized and shaped to be received within the interior space 125 of the cooling panel body 120. The cooling sheet 180 has a rear surface 185 and a front surface 190. In the version of FIG. 1, the rear surface 185 is on the rear facing side 160 of the cooling member 110, and the front surface 190 is on the front facing side 165 of the cooling member 110. Between the rear surface 185 and the front surface 190 are one or more cooling member compartments 195 that contain a cooling medium. The front surface 190 of the cooling sheet 180 includes the airflow channeling system 170. In the particular version of FIG. 1, the airflow channels 175 of the airflow channeling system 170 are formed by the spaces between the cooling member compartments 195.

Figure 2:
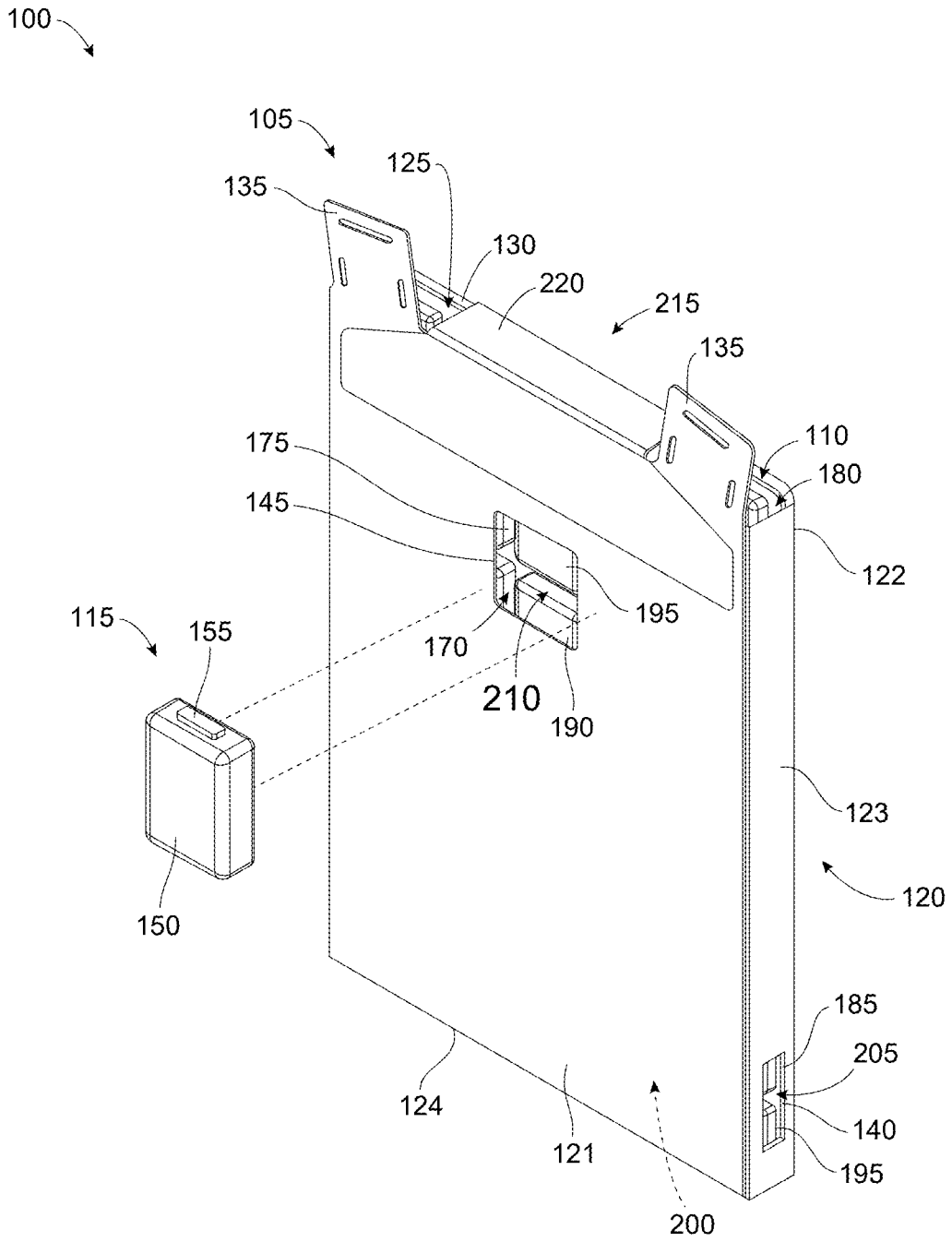
FIG. 2 is a schematic front perspective partially-assembled view of the cooling system of FIG. 1.

The cooling member 110 can be inserted into the interior space 125 by passing the cooling member 110 through the opening 130 in the top region of the cooling panel body 120 so that the cooling member 110 is positioned as shown in FIG. 2. When in the interior space 125, the cooling member 110 is positioned between the one or more panel air inlets 140 and the one or more panel air outlets 145. As can be seen in FIG. 2, the airflow channels 175 of the airflow channeling system 170 of the cooling member 110 create an airflow pathway 200 that has a first end 205 at or near the panel air inlet 140 and a second end 210 at or near the panel air outlet 145. Air flowing in the interior space 125 of the cooling panel body 120 from the panel air inlet 140 to the panel air outlet 145 is flows through the airflow pathway 200 and is cooled by the cooling member 110. In this way, air exiting the cooling panel body 120 at the panel air outlet 145 has a lower temperature than air entering the cooling panel body 120 at the panel air inlet 140. When actuated, the fan member 115 can draw air through the airflow pathway 200 and then blow the lower temperature air exiting the cooling panel body 120 in a desired direction through the fan air outlet 155, such as in the direction of an individual in need of being cooled.

Optionally, a closure 215 can be provided, such as the flap 220 shown in FIG. 2, for at least partially closing the opening 130 to help contain the cooling member 110 within the interior space 125 and/or to help maintain a cool environment within the interior space 125. The flap 220 can be secured with an item such as hook and loop fastener, buckles, clasps, snaps or the like. Alternatively, the flap 220 can be replaced by any other type of closure 215, such as a zipper, snaps, hook and loop fasteners, and the like.

Figure 3:
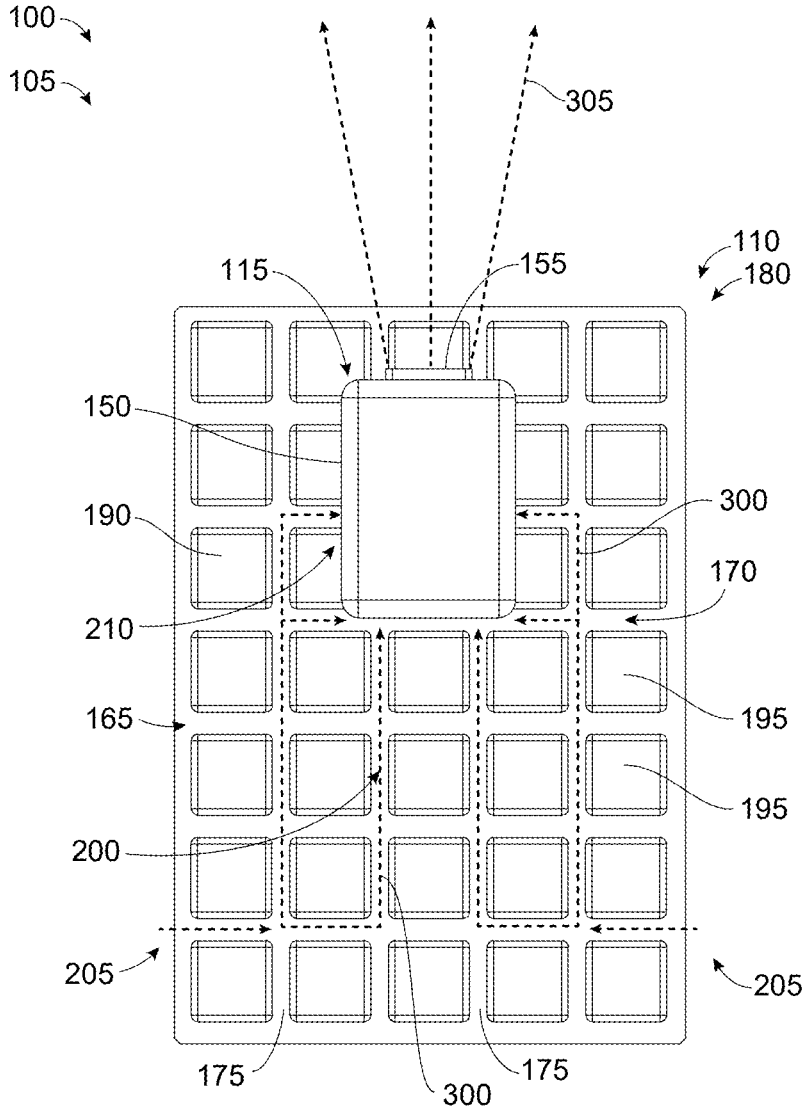
FIG. 3 is a schematic front view of the cooling system of FIG. 1 with a panel body removed for clarity.

FIG. 3 shows a front view of the cooling system 100 of FIGS. 1 and 2 with the cooling panel body 120 removed for illustration clarity purposes. As can be seen, the airflow channels 175 of the airflow channeling system 170 create the airflow pathway 200 of the airflow channeling system. In the version shown, the airflow pathway 200 that is created by the airflow channeling system 170 creates a tortuous path 300 for air flowing from the panel air inlet 140 to the panel air outlet 145. By tortuous path it is meant that the air flow pathway follows a route other than a direct line between the panel inlet 140 and the panel outlet 145 and/or follows a route that includes one or more bends, twists, turns, constrictions, or the like beyond that which would be the most direct route from the panel air inlet 140 to the panel air outlet 145. In accordance with this version of the cooling system 100, the airflow pathway 200 that follows a tortuous path 300 can generally follow a single tortuous path, or the airflow pathway 200 can divide into multiple flow components, as shown in FIG. 3, that follow different pathways with at least one of the flow component pathways being a tortuous path. The tortuous path 300 of the airflow pathway 200 can be designed for one or more purposes aimed at increasing the heat transferred to air flowing through the airflow pathway 200. For example, the airflow pathway can be designed to create or increase turbulence of the air flow. Turbulent flow is more efficient in accomplishing heat exchange than laminar flow. In one version, the turbulent flow can be created by forcing the air to flow into itself, into surfaces, to take sharp angles or turns, to spread into small passageways, and/to flow over surface disruptions. For example, as can be seen in the version of FIG. 3, air entering the panel air inlet 140 can be forced to take multiple turns around cooling member compartments 195 of the cooling member 110. This can have the effect of creating turbulence and spreading out the flow in various directions. In addition, as can be seen in the version shown, air in the airflow pathway can be redirected to flow up, down, and/or around the cooling member compartments 195 as the air winds its way towards the panel air outlet 145 and as it is being drawn towards the fan member 115. Turbulent flow can continue by providing additional turns that continue to redirect the flow as the air continues its flow along a tortuous path 300. These redirectional turns not only help to create turbulence but also can help to increase residence time, as discussed below. While substantially 90 degree turns are shown in the version of FIG. 3, the turns can be more gentle or arcuate and/or more acute or obtuse than shown.

In one version, the airflow pathway 200 follows a tortuous path 300 that is designed to increase the residence time of air in the chest interior space 125 of the cooling panel body 120 and/or in proximity to a cooling member 110. By increasing the residence time, there is more time for heat exchange between the air and the cooling member 110 to occur. The longer the air stays in the region where it is being cooled, the cooler it will become. This increase in residence time can be achieved by redirection out of the direct path from panel air inlet 140 to panel air outlet 145 as discussed above in connection with the turbulent flow and/or can be achieved in a different manner. Accordingly, the length of the airflow pathway 200 from an panel air inlet 140 to the panel air outlet 145 can be longer than the direct distance from the an inlet 140 to the air outlet 145, and in one version the length of the airflow pathway 200 from the panel air inlet 140 to the panel air outlet 145 can be at least about 115 percent or at least about 130 percent of the direct distance from the panel air inlet 140 to the panel air outlet 145. In the particular version of FIGS. 1 and 2, as illustrated in FIG. 3, the airflow pathway 200 can include multiple paths causing the air flow to bifurcate one or more times thus additionally adding to the residence time and/or the amount of contact with the cooling member 110. The airflow pathway 200 can also be designed to cause a thinning of the air in the airflow pathway 200. By thinning the flow, a greater amount of the air is in contact or near contact with a surface of the cooling member 110 which can help facilitate heat exchange between the air and the cooling member 110 and thus better chill the air in the airflow pathway 200. Additional details about various types of cooling members 110 and airflow pathways 200 is described in U.S. patent application Ser. No. 18/900,499 filed on Sep. 27, 2024 and entitled "Portable Air Cooler" which is incorporated herein by reference in its entirety.

The cooling member 110, such as the cooling sheet 180 shown in FIGS. 1 and 2, can be sized and shaped to be removably insertable into the interior space 125 of the cooling panel body 120 when the opening 130 is open. When not in use in the cooling system 100 and/or when being prepared for use in the cooling system 100, the cooling member 110 can be placed in a cold environment, such as a freezer or ice bath, to lower its temperature a desired amount. In the version shown, the cooling member 110 includes one or more compartments 195 that contain a cooling medium, such as a freezable or an at least partially freezable material. When the cooling member 110 is in a cooling state, such as by being at a desired temperature below the ambient temperature, it may be inserted into the interior space 125 of the cooling panel body 120 so that it is ready to cool the air passing through the airflow pathway 200 and to cool the interior space 125 and thus the cooling panel body 120. During use, the temperature of the cooling member 110 will gradually increase to the point where it is no longer adequately cooling the air in the airflow pathway 200. At that point, the warm cooling member 110 can be removed so that it can be rechilled and/or replaced by a different cooling member 110 that has been chilled.

In the particular version of FIGS. 1 and 2, the cooling member 110 is in the form of one or more cooling sheets 180 that have a plurality of compartments 195 each containing a cooling medium. The one or more cooling sheets 180 are frozen or chilled to chill the cooling medium. The passage of air around the compartments 195 and/or between and through the sheets 180 when there are multiple sheets 180 forms the tortuous path 300 of the airflow pathway 200 that cools the air. In one version, the cooling medium is a substance that freezes at or near 32 degrees F., such as water. Alternatively, the cooling medium can comprise a substance that freezes at less than 32 degrees F., such as one or more of saturated salt water, polypropylene glycol, hydroxyethyl cellulose, sodium polyacrylate, silica gel, and the like. In one version, the cooling sheet 180 can be made of thin thermoformed plastic sheets with compartments 195 in the form of small sealed rectanguloids containing water that can be frozen into ice.

In the version of FIGS. 1 and 2, the fan member 115 is shown as being positioned or positionable on or near the front wall 121 of the cooling panel body 120 so that it can receive cool air from the cooling panel body 120 exiting through the panel air outlet 145. The fan member 115 then blows the cool air 305, as shown in FIG. 3, in a desired direction, such as towards an individual. When the blown cool air 305 contacts the individual it cools the individual by convection. The fan air outlet 155 can optionally be provided with an air directing system that allows an individual to alter or adjust the direction of the flow of the blown cool air 305 as it exits the fan air outlet 155.

Figure 4:
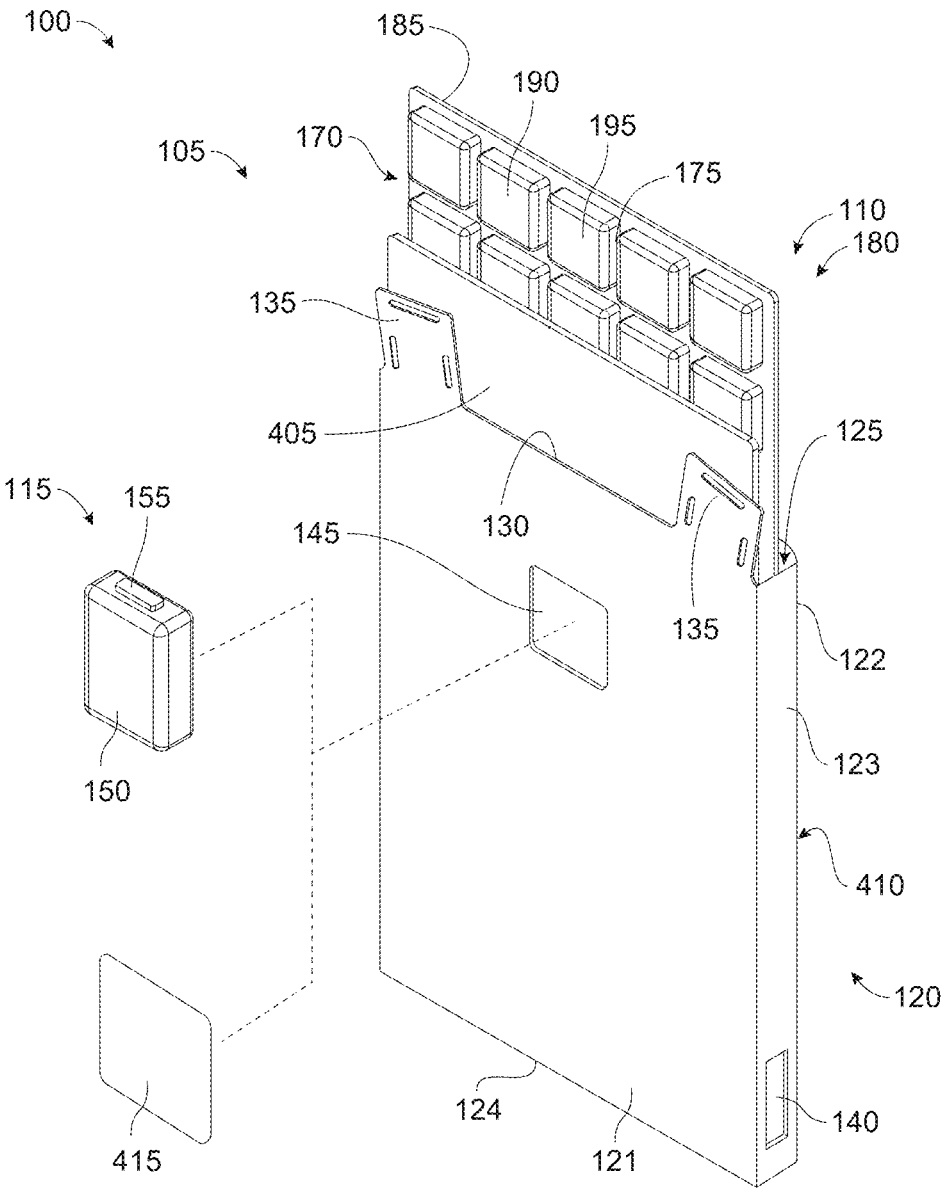
FIG. 4 is a schematic front perspective view of another version of a cooling system of the invention.

FIG. 4 shows another version of a cooling system 100 of the invention. The cooling system 100 of FIG. 4 is similar to the version of FIG. 1 but with some additional features. For example, in the version of FIG. 4, a layer of insulation 405 is provided within the interior space 125 of the cooling panel body 120. In this particular version, the layer of insulation 405 is positioned or positionable between the cooling member 110 and the front wall 121 of the cooling panel body 120. The insulating layer 405 can be removable through the opening 130, as shown in FIG. 4, or can be integrally associated with the front wall 121 of the cooling panel body 120. The insulating layer 405 can also have a hole, hidden from view in FIG. 4 by the front wall 121, that aligns with the panel air outlet 145 when the insulating layer 405 is in position within the interior space 125 of the cooling panel body 120. The insulating layer 405 can be made of common insulating materials, such as one or more of synthetic fibers, neoprene, foam sheets, and the like. The insulation layer 405 helps to reduce heat transfer through the front of the cooling panel body 120 thereby extending the useful life of the cooling member 110. All sides of the cooling panel body 120 that are not to be used as for conduction cooling can be provided with an insulation layer 405.

The version of FIG. 4 with the insulation layer 405 between cooling member 110 and the front wall 121 of the cooling panel body 120 is particularly useful for directing the conduction aspects of the cooling system 100. For example, by having an insulation layer 405 between the cooling member 110 and the front wall 121 and no insulation layer between the cooling member 110 and the rear wall 122, more of the cooling effect will be directed towards the rear wall 122. This better allows the rear wall 122 to operate as a conduction surface 410. Accordingly, an individual directly or indirectly contacting the rear wall 122 will be cooled by the process of conduction as heat is transferred away from the individual and into the cooler conduction surface 410. The layer of insulation 405 thus improves the effectiveness and efficiency of cooling along the conduction surface 410 while at the same time helping to maintain the airflow pathway 200 at a reduced temperature for a longer period of time than in the absence of the insulation layer 405. In one version, a layer of heat spreading material can be provided between the cooling member 110 and the rear wall 122 and/or can be incorporated into the rear wall 122. The heat spreading material serves to more evenly spread the temperature across the conduction surface 405. Heat spreading materials have a higher in-plane thermal conductivity than through plane conductivity so the temperature distribution across the surface is more consistent. Examples of heat spreading materials include dyneema fabrics, dyneema composite fabrics, and/or a material that comprises pyrolytic graphite. The heat spreading material can be provided as part of a wall of the cooling panel body 120, as an integrated portion of the cooling panel body 120, or as an insert that is selectively insertable into the interior space 125 of the cooling panel body 120.

The version of FIG. 4 can be used to cool an individual by conduction, by convection, or by both conduction and convection. For example, in the version of FIG. 4, the fan member 115 is releasably connectable to the front wall 121 in a position where it is in flow communication with the panel air outlet 145 so that the fan member 115 can blow cool air 305 towards an individual, as discussed above in connection with the version of FIG. 1. When the fan member 115 is operated when the conduction surface 410 is not contacting an individual, the cooling system 100 cools the individual by convection, and when the conduction surface 410 directly or indirectly contacts an individual while cool air 305 is being blown on the individual, the cooling system 100 cools by both convection and conduction. Optionally, the fan member 115 can be turned off or the blown cool air 305 can be directed away from the individual, and the cooling member 100 in this case cools by conduction only. Also, in the version of FIG. 4, the fan member 115 can be removed from the front wall 121 and replaced by a panel air outlet cover member 415 that covers the panel air outlet 145 when convection cooling is not being used. The cover member 415 can optionally be provided with a layer of insulation. In one version, the fan member 115 and the cover member 415 are releasably attachable to the front wall 121 of the cooling panel body 120 by the same mechanism, such as hook and loop fasteners or the like. The cover member 415 can also be used to cover the panel air outlet 145 when the cooling system 100 is not being used to help maintain the life of the cooling system by keeping the cooling member 110 cool for a longer period of time. The cover member 415 can be made of similar materials as the cooling panel body 120 walls and/or the insulation layer 405.

Figure 5:
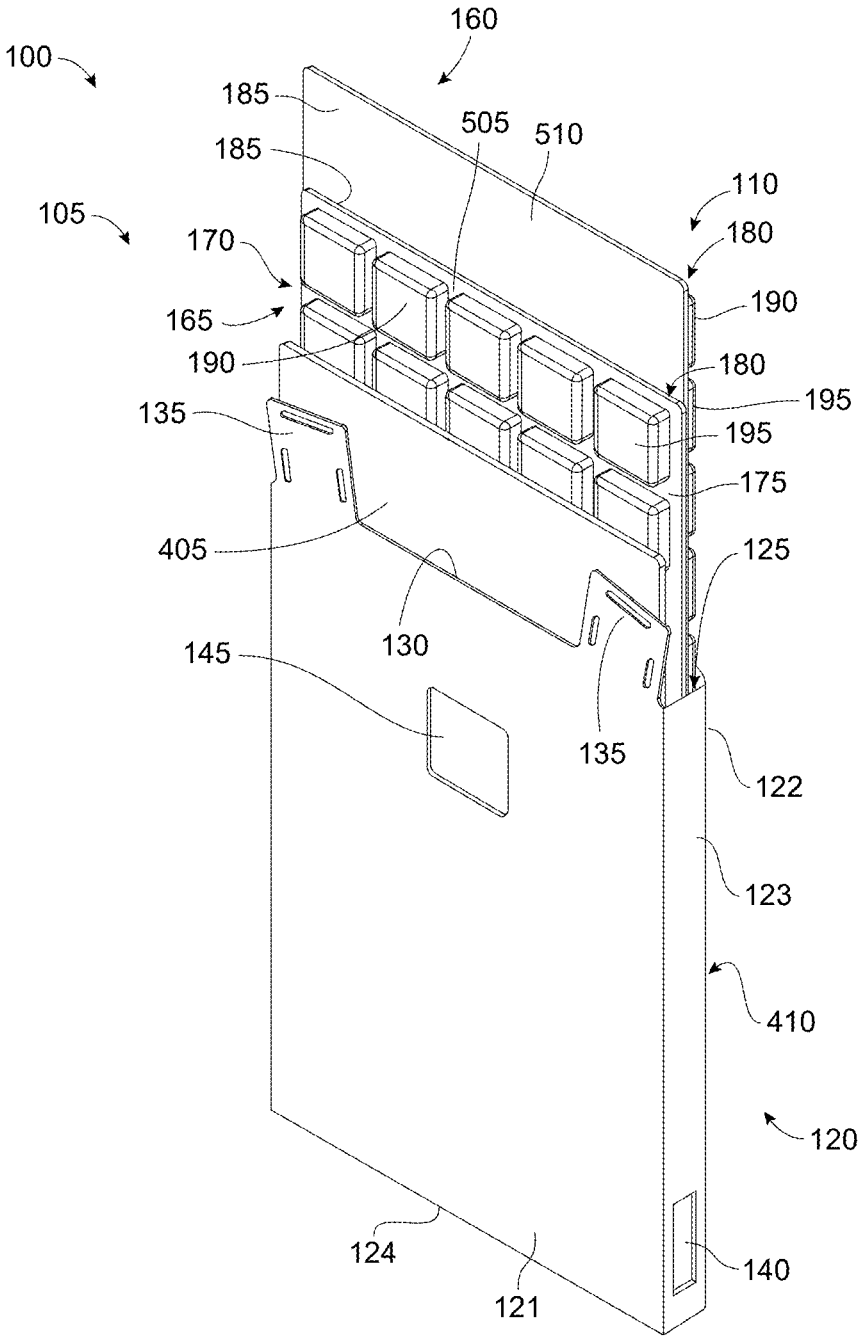
FIG. 5 is a schematic front perspective view of another version of a cooling system of the invention.

FIG. 5 shows another version of the cooling system 100 of the invention. The version of FIG. 5 is similar to the version of FIG. 4, but in the version of FIG. 5, the cooling member 110 comprises a plurality of cooling sheets 180, such as a front cooling sheet 505 and a rear cooling sheet 510. In the version shown, the rear cooling sheet 510 is similar to the front cooling sheet 505 but is rotated 180 degrees so that the cooling sheet front surface 190 of the rear cooling sheet 510 is the cooling member rear facing side 160, and the cooling sheet rear surface 185 of the rear cooling sheet 510 faces the rear facing side 160 of the front cooling sheet 505. Alternatively, the rear cooling sheet 510 can be inserted into the interior space 125 of the cooling panel body 120 in the same orientation as the front cooling sheet 505. Optionally, a third or more cooling sheet can be inserted between the front cooling sheet 505 and the rear cooling sheet 510. The use of a plurality of cooling sheets 180 extends the effective life of the cooling member 110. In addition, the plurality of cooling sheets 180 provides an additional cooling effect and is particularly useful when the cooling panel 105 is to be used for both convection and conduction cooling. In the arrangement shown in FIG. 5, the front cooling sheet 505 is used primarily for chilling the air in the airflow pathway 200 that is used for convection by being blown by the fan member 515 (not shown in FIG. 5 for clarity), whereas the rear cooling sheet 510 is used primarily for conduction cooling through the conduction surface 410 of the rear wall 122. The separate cooling sheets 180 can be separately replaced, so that if one of the cooling sheets 180 is warming faster than the other, such as if more convention cooling is occurring than conduction or vice versa, the warmer sheet can be replaced while leaving the cooler sheet in the interior space 125 of the cooling panel body 120. The front cooling sheet 505 and the rear cooling sheet 510 may be separable, as in the version shown, or can be fixed or coupled together as a single unit.

Figure 6:
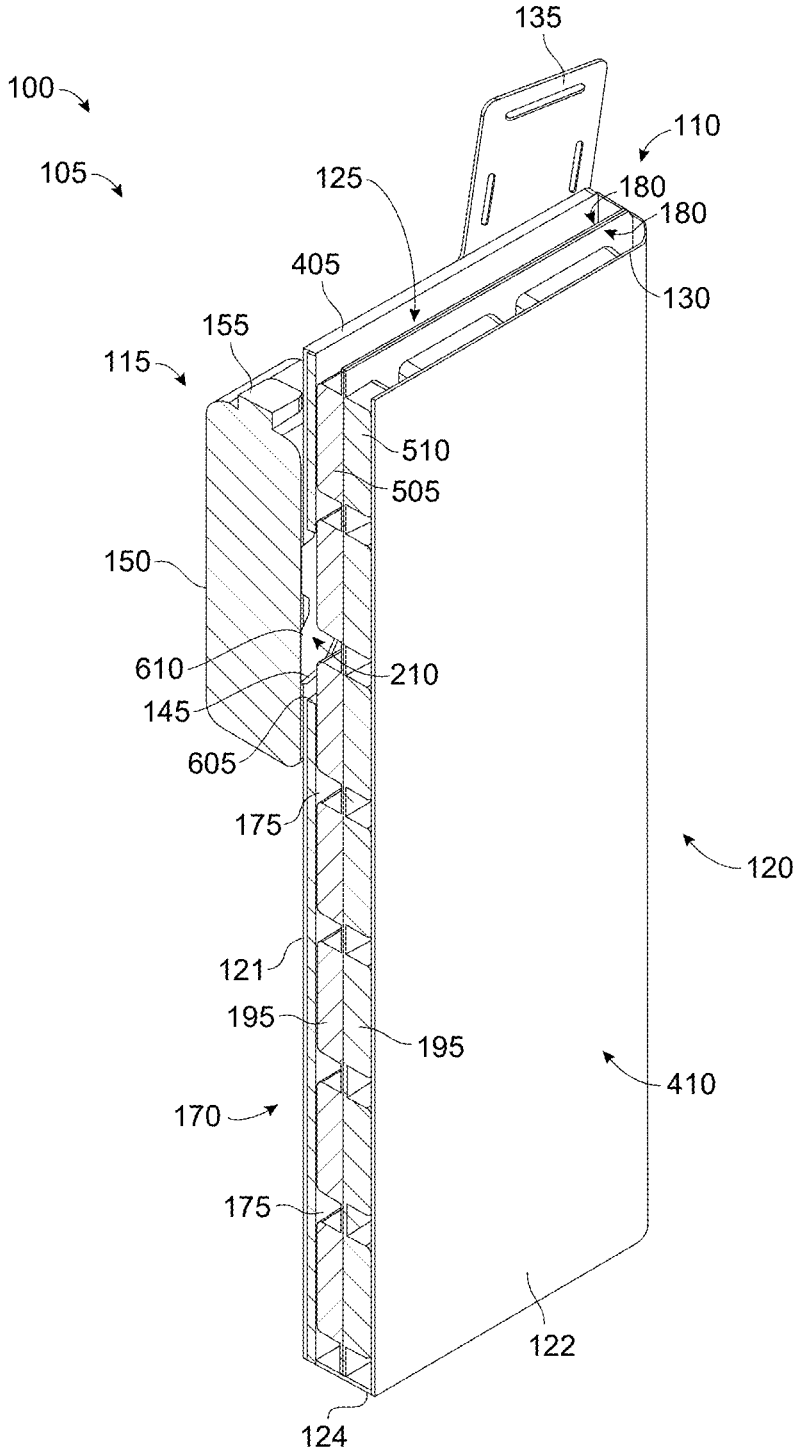
FIG. 6 is a schematic rear perspective view in partial section view of the cooling system of FIG. 5.

FIG. 6 shows the rear side of the cooling system 100 of FIG. 5 in a partial vertical section and with the fan member 115 attached to the front wall 121 of the cooling panel body 120. In this view, the insulation layer opening 605 can be seen to be aligned with the panel air outlet 145 and the fan air inlet 610 so that chilled air at the airflow pathway second end 210 exiting the interior space 125 of the cooling panel body 120 can flow though the insulation layer 405 out the panel air outlet 145 and into the fan member 115 where in can be blown out the fan air outlet 155. FIG. 6 also shows the conduction surface 410 on the rear wall 122. The compartments 195 of the rear cooling sheet 510 and spacing between the compartments 195 and/or the spacing between the compartments and the rear wall 122 along with the thickness and material of the rear wall 122 are designed to provide a desired amount of conduction cooling so that a cooling effect can be provided without the surface being uncomfortably cold to the touch. These factors can be adjusted based on the manner in which the cooling panel is to be used. While the version of FIGS. 5 and 6 utilizes the front cooling sheet 505 primarily for the airflow pathway 200 for convection cooling and utilizes the rear cooling sheet 510 primarily for cooling the conduction surface 410, the two sheets can also be used together for one or both of the purposes. For example, the airflow pathway 200 can be designed to meander through the rear cooling sheet 510 in addition to the front cooling sheet 505 to further increased the tortuous path of the air being chilled between the panel air inlet 140 and the panel air outlet 145.

Figure 7:
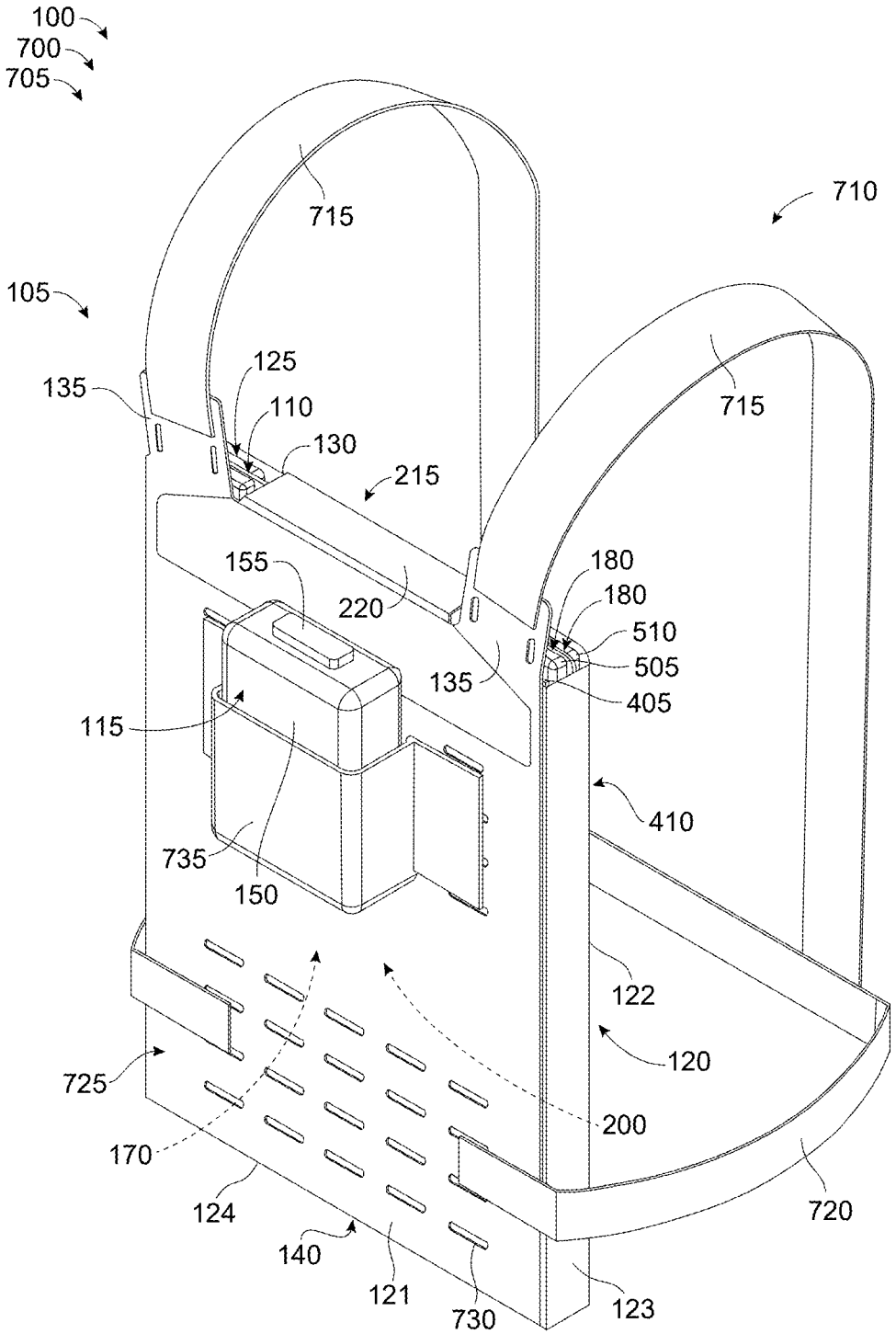
FIG. 7 is a schematic front perspective view of another version of a cooling system of the invention.

FIG. 7 shows a version of the invention in which the cooling system 100 is a wearable cooling system 700 in the form of a wearable garment, such as a cooling vest 705. The individual to be cooled is a wearer of the wearable cooling system 700. In this version, the cooling system 100 comprises a cooling panel 105 in accordance with any of the versions described herein along with a supporting system 710 that is adapted to support the cooling panel 105 on or in proximity to a wearer so the cooling panel 105 can be supported on the wearer's body and worn during an activity. By cooling vest it is meant a device designed so that one or more cooling panels 105 are positionable in proximity to, such as by directly or indirectly contacting, a wearer's front and/or back torso region. In the particular version of FIG. 7, a cooling panel 105, such as the cooling panel 105 shown in FIG. 7 which is similar to the version of FIGS. 5 and 6. The supporting system 710 of the cooling vest 705 of FIG. 7 includes one or more shoulder straps 715 adapted to extend over the shoulders of the wearer so the cooling panel 105 can be positioned on or near the wearer's chest or other part of the wearer's torso. In this position, the conduction surface 410 on the rear wall 122 can contact the wearer directly or through the wearer's clothing or other intermediary to provide cooling of the wearer by conduction and/or the fan air outlet 155 can blow cool air towards the wearer's face or elsewhere towards the wearer's body or towards another individual. Optionally, one or more side straps 720 can also or alternatively be provided for additional security and/or to provide additional flexibility for the mounting location on the wearer's body. The shoulder straps 715 and/or the side straps 720 can be made of fabric material such as webbing and can be sewn in place or removably connectable by buckles or the like. As will also be apparent, the fan member 115 can be removed and replaced with a cover member 415 when convention cooling is not desired.

The version of the cooling panel 105 of FIG. 7 also shows some additional features. For example, the front wall 121 of the cooling panel body 120 can include a modular light-weight load-carrying equipment (MOLLE) system 725 including one or more pouch attachment ladder system (PALS) webbing 730 that allows items to be secured to the front wall 121 of the cooling panel body 120. In the particular version shown, the side straps 720 can be attached using the MOLLE system 725 or can alternatively be attached by any other suitable attachment. Also in the version shown, a fan member holder 735, such as a pocket, is provided to hold the fan member 115 in position on the front wall 121 of the cooling panel body 120. In the version shown, the fan member holder 735 is attachable to the front wall 121 of the cooling panel body 120 by the MOLLE system 725. Alternatively, the fan member pocket 121 can be attached by any of suitable attachment system, such as hook and loop fasteners, snaps, buttons, and the like. In the version shown, the shoulder straps 715 are releasably connected to the attachment member 135 of the cooling panel body 120 by any suitable connection type, such as conventional buckles, snaps, MOLLE system, or the like. While the supporting system 710 is shown as being shoulder and/or side straps, any other supporting system 710 that positions the cooling panel 105 on the wearer in a desired location can be provided. For example, the supporting system 710 can be a mechanism that attaches the cooling panel 105 to a garment or can be pockets in a garment.

Also in the version of FIG. 7, the panel air inlet 140 is positioned on the bottom wall 124 of the cooling panel body 120 to help prevent interference from the side straps 720 and/or the wearer's arms or the like. As mentioned above, the panel air inlet 140 can be one or more inlets that are positioned anywhere on the cooling panel body 120, such as on the bottom wall 124, as in this version, on one or more side walls 123, as previously shown, on a top surface, such as on the flap 220 or a portion of the top that is not part of the closure 215, and/or on the front wall 121 at a location spaced from the panel air outlet 145. The panel air inlet 140 is preferably positioned in a location where there will be minimal obstructions to the inflow of air. Accordingly, in versions where the rear surface 122 or other surface is to be used as a conduction surface 410, the panel air inlet 140 will typically not be positioned on that surface. However, for versions where the rear wall 122 is not to be used as a conduction surface 410, the panel air inlet 140 can be positioned there. It may also be positioned on a conduction surface 410 in some situations, such as when the possible obstruction from a contacting surface or individual is desired and/or when structure or design is included to reduce the amount of obstruction.

Figure 8:
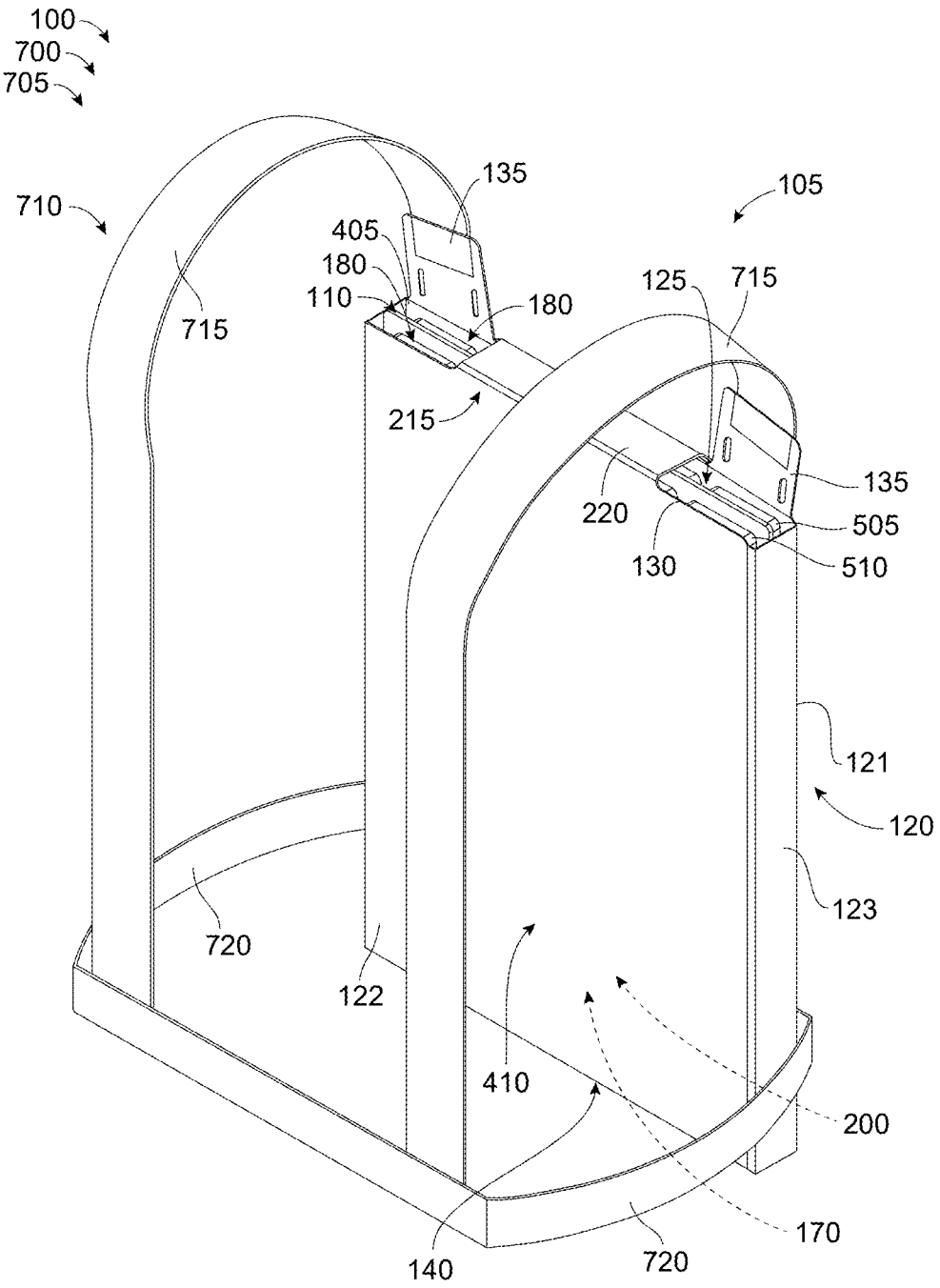
FIG. 8 is a schematic rear perspective view of the cooling system of FIG. 7.

FIG. 8 shows a rear view of the wearable cooling system 700 of FIG. 7. As can be seen, the rear wall 122 and conduction surface 410 can face the wearer's chest to provide conduction cooling to the chest area. Alternatively, the wearable cooling system 700 of FIG. 7 can be rotated 180 degrees and worn so that the cooling panel 105 is positioned on the wearer's back with the rear wall 122 and the conduction surface 410 facing forwardly and towards the wearer's back. In this or in any other version, tubing or ducts can be provided from the fan air outlet 155 so the cool air can be directed around the top of the cooling panel body 120 and towards the wearer, such as towards the back of the wearer's neck.

Figure 9:
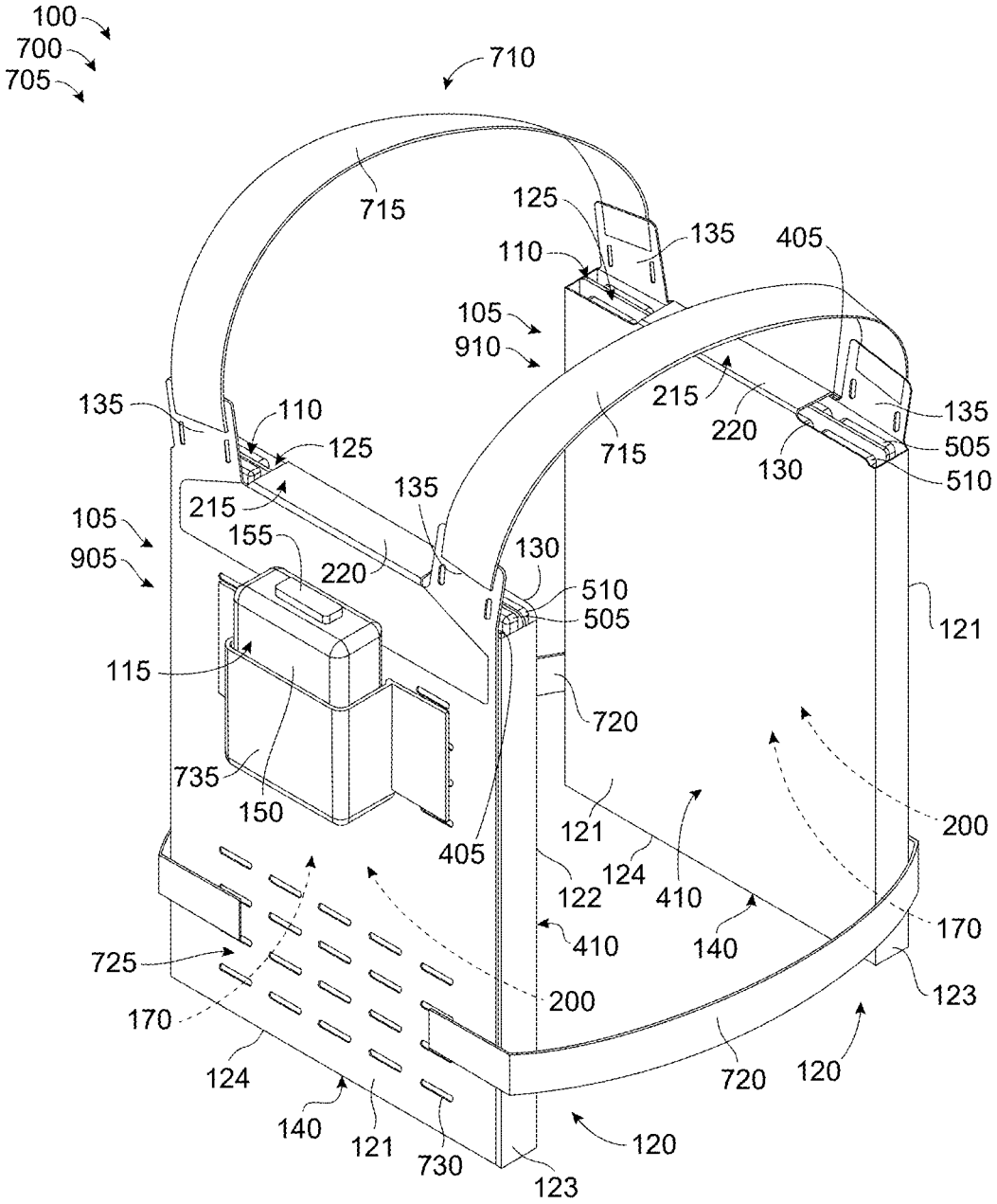
FIG. 9 is a schematic front perspective view of another version of a cooling system of the invention.
Figure 10:
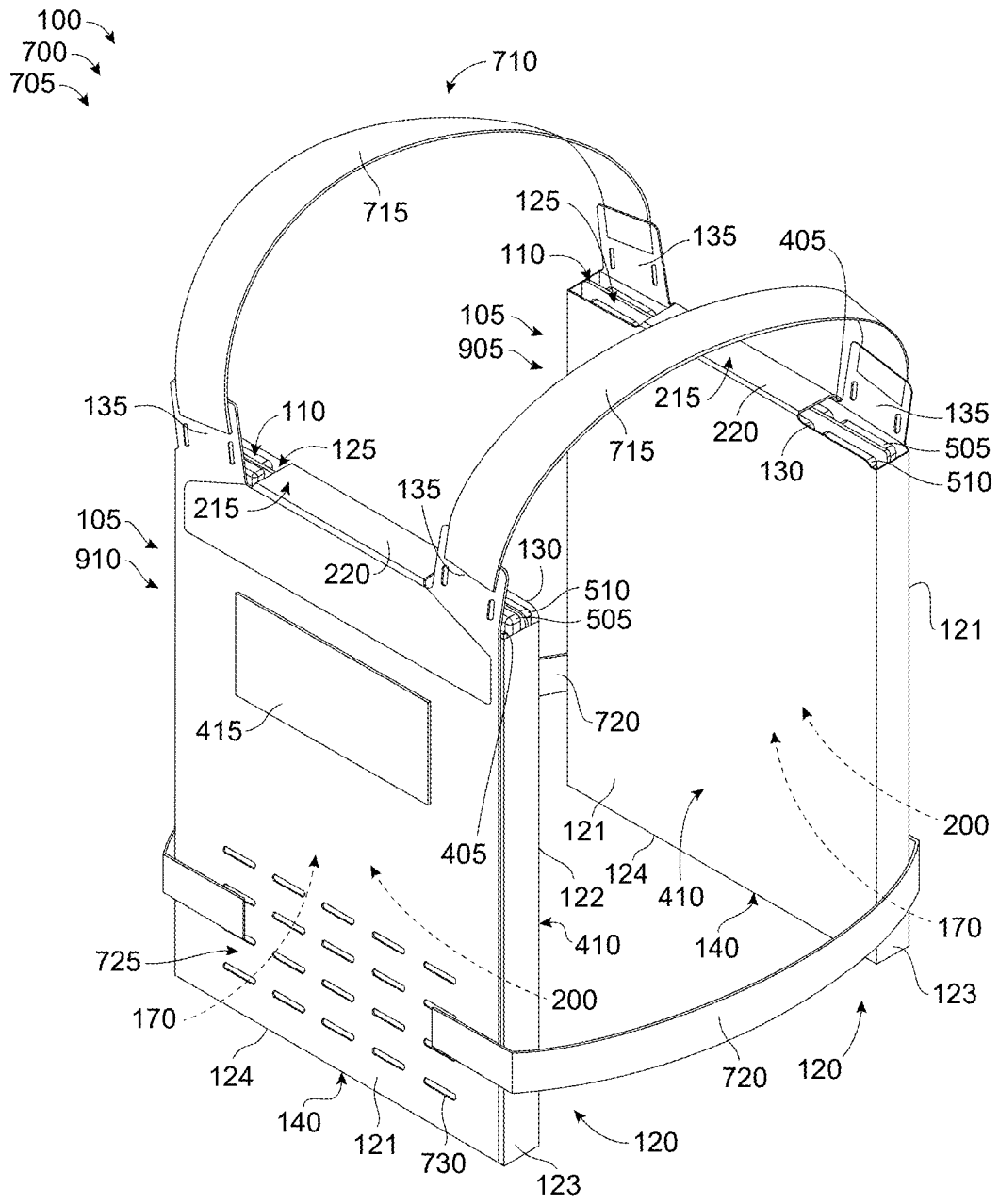
FIG. 10 is a schematic rear perspective view of the cooling system of FIG. 9.

FIG. 9 shows another version the cooling system 100 in the form of a cooling vest 705. In this version, the cooling system 100 comprises a first cooling panel 905 and a second cooling panel 910, each of which are in accordance with any of the versions described herein and can be the same or different and can be the same size and shape or differently sized and shaped. In the particular version shown, each of the first cooling panel 905 and the second cooling panel 910 are the panel shown in FIG. 7. The supporting system 710 in this version is adapted to support both the first cooling panel 905, such as a front cooling panel, and the second cooling panel 910, such as a rear cooling panel, by the one or more shoulder straps 715 and/or the one or more side straps 720 or by another other support system as discussed above. As can be seen, in the version of FIG. 9, the first cooling panel 905 and the second cooling panel 910 are oriented relative to one another so that the conduction surface 410 of each of the cooling panels faces the wearer. The cooling vest 705 of FIG. 9 provides front torso or chest conduction cooling, front body or face convection cooling, rear torso or back conduction cooling, and/or rear body or back of neck convection cooling. FIG. 10 shows a rear view of the version of FIG. 9. In the configuration shown, the cover member 415 is attached instead of the fan member 115 on the second cooling panel 910. Alternatively, a fan member 115 can be provided on both the first cooling panel 905 and the second cooling panel 910.

Figure 11:
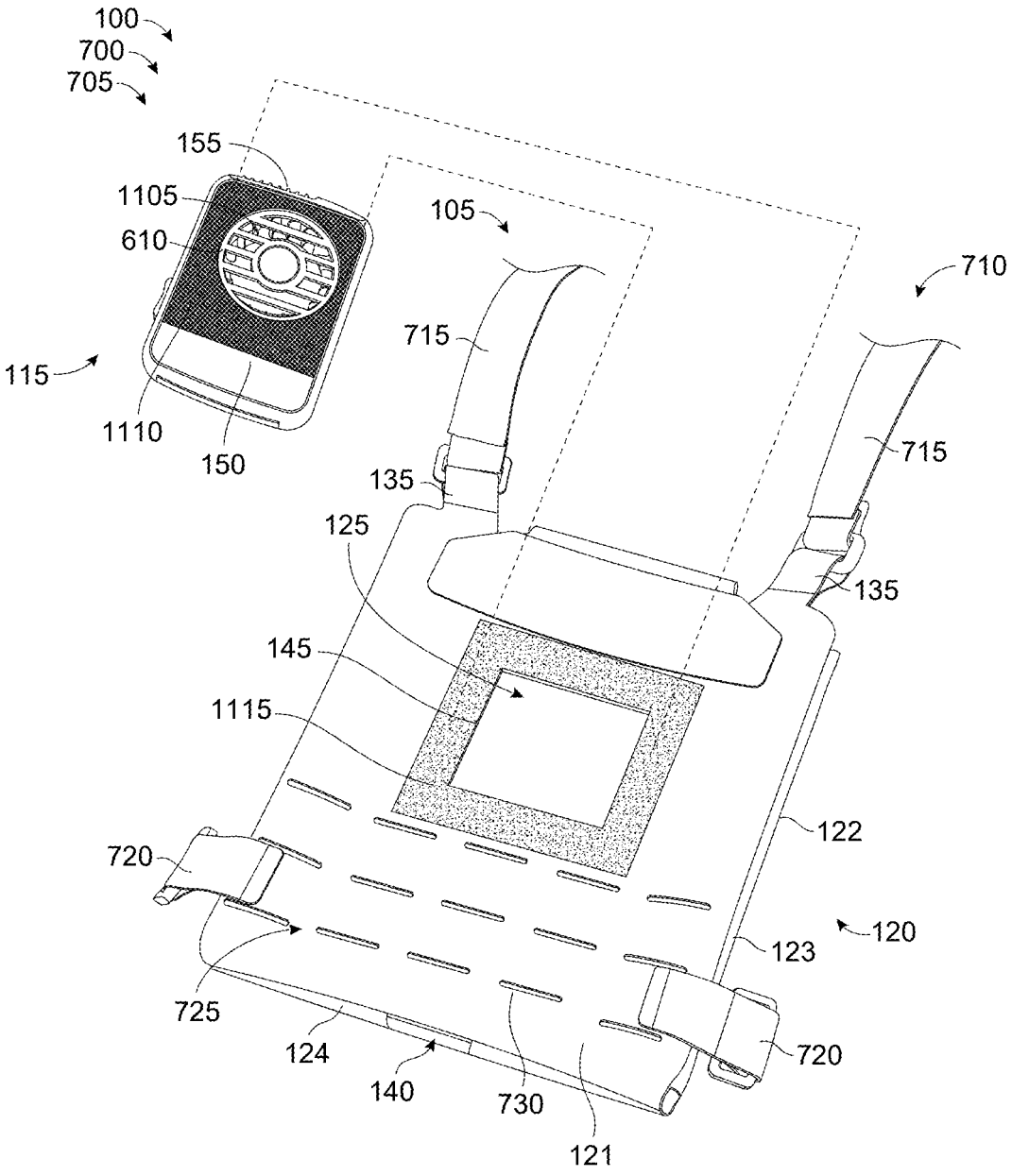
FIG. 11 is a schematic front perspective view of another version of components of a cooling system of the invention.

FIG. 11 shows another version of a cooling system 100 of the invention. In FIG. 11, the cooling member 110 is not shown within the cooling panel body 120 for clarity purposes. FIG. 11 shows a specific version of a fan member 115 and the connection mechanism by which manner the fan member 115 is releasably connectable to the cooling panel body 120. The fan member 115 includes a fan 1105 in flow communication with the fan air inlet 610. In the version shown, a first side of a hook and loop fastening system 1110 is attached to the fan housing 150 and a second opposite side of the hook and loop fastening system 1115 is attached to the front wall 121 of the cooling panel body 120, such as by at least partially surrounding the panel air outlet 145. When the fan member 115 is connected to the cooling panel body 120 by mating the first side of the hook and loop fastening system 1110 to the second side 1115, the fan member 115 can be held in place on the cooling panel body 120 with the fan air inlet 610 aligned with the panel air outlet 145. Alternatively, the hook and loop fastening system can be replaced by any other releasable connection mechanism, such as snaps, buttons, or Molle system, or can be permanently connected. When not permanently connected, as in the version of FIG. 11, the cover member 415 (not shown in FIG. 11) can include a connector that matches the connector on the fan housing 150, such as the first side of the hook and loop fastener system 1110. The fan member 115 can be any commercially available fan to which the connector can be attached.

The cooling panel 105 and the cooling panel body 120 can be made of any suitable material. Particularly in the versions in which the cooling panel body 120 makes up a portion of a cooling vest 705, the cooling panel body 120 can be made of molded plastic or sewn textiles. In one version, the cooling panel body 120 walls can be made of a durable fabric such as nylon fabric, Cordura, ripstop nylon, canvas, weldable fabric, or the like. The shoulder straps 715 and/or side straps 720 can be made of nylon webbing or durable material similar to the vest panels.

Figure 12:
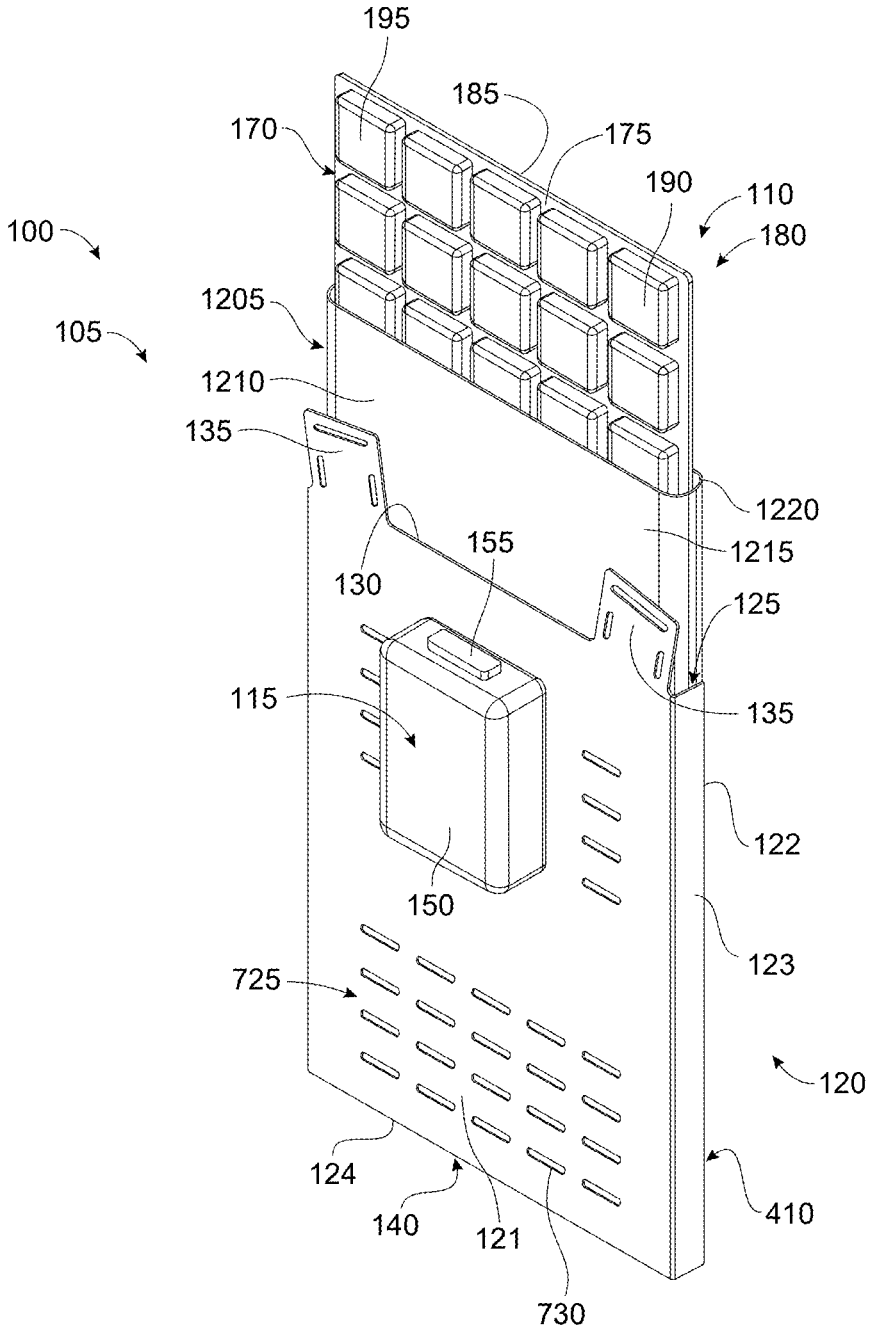
FIG. 12 is a schematic front perspective view of another version of a cooling system of the invention.

FIG. 12 shows another version of a cooling system 100 and cooling panel 105 of the invention. In the version of FIG. 12, a pouch 1205 is provided for the containing one or more of the components that are insertable into the interior space 125 of the cooling panel body 120. For example, the pouch 1205 can contain the cooling member 110, such as the one or more cooling sheets 180, and optionally can contain the insulation layer 405. Alternatively, the insulation layer 405 can be insertable in the interior space 125 separately, can be permanently provided in the interior space 125, or may not be provided. The pouch 1205 provides for simplified and convenient insertion of the components and/or storage of the components when they are not in use within the interior space 125. The pouch comprises a pouch body 1210 having a front side 1215 and a rear side 1220. In one version, the pouch body is made of a mesh material that allows for the passage of air and the easy transfer of heat. In another version, the front side 1215 and the rear side 1220 are made of different materials. For example, in one version, the front side 1215 can be made of mesh and the rear side 1220 can be made of a material to control the interface temperature between the cooling member 110 and the rear wall 122 of the cooling panel body 120 and/or the individual to be cooled. In one particular version, the front side 1215 is made of mesh material, and the rear side 1220 is a heat spreading material, as discussed above. In another version, the front side 1215 can comprise an insulation layer 405 and can include an insulation layer opening 605 that aligns with the panel air outlet 145.

Figure 13:
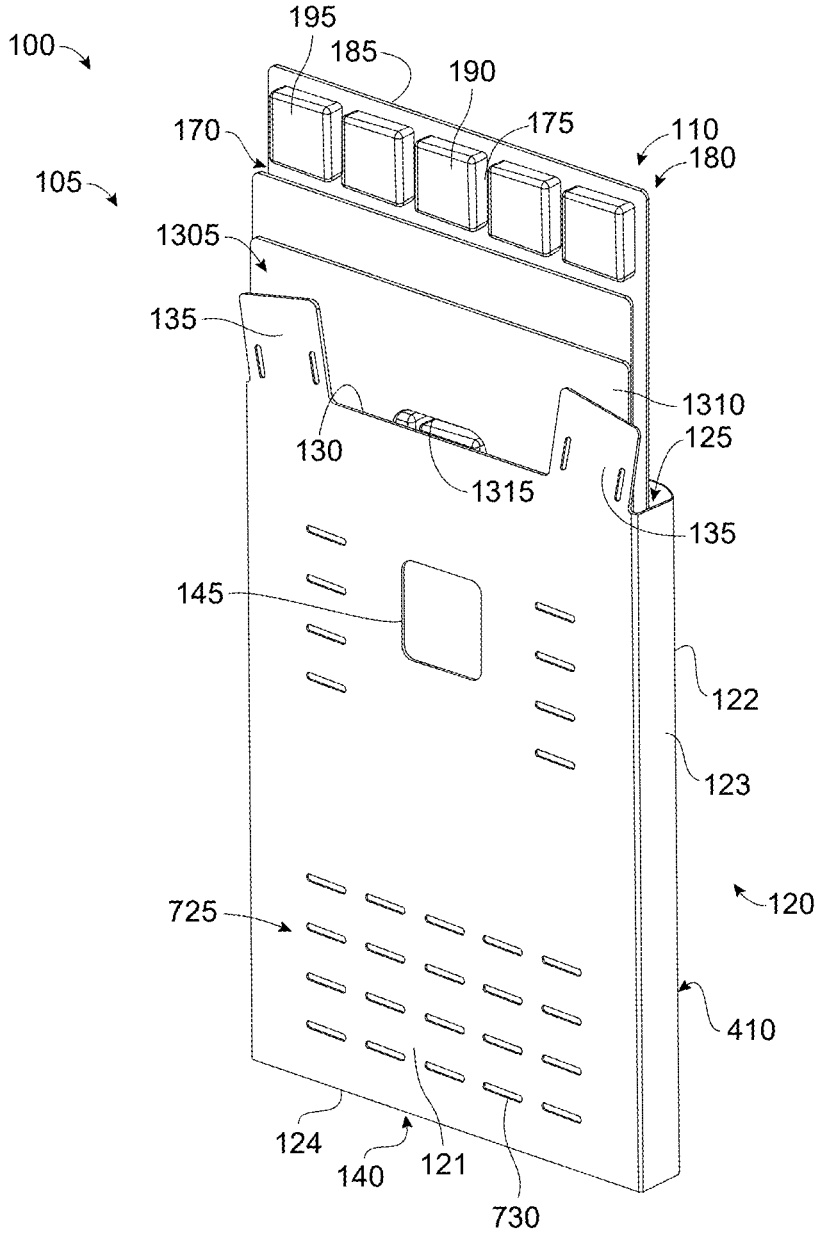
FIG. 13 is a schematic front perspective view of another version of a cooling system of the invention.

FIG. 13 shows another version of a cooling system 100 and cooling panel 105 of the invention. In the version of FIG. 13, a weighted member 1305, such as a weight plate 1310 is insertable into the interior space 125 of the cooling panel body 120. The weighted member allows the cooling panel 105 to be used in a weighted vest or the like. Weighted vests are useful for enhancing workouts and improving fitness. The weighted member can be small enough that it does not interfere with the airflow pathway 200 or, as shown in FIG. 13, can have a weighted member opening 1315 that corresponds in position with the panel air outlet 145. The weighted member 1305 can comprise a material that is heavier and/or denser than the material of the cooling panel body 120 and/or insulation layer 405. For example, the weighted member 1305 can comprise one or more metals, such as steel and/or lead. The weighted member 1305 can be positioned elsewhere in the interior space 125 or on the cooling panel body 120.

Figure 14:
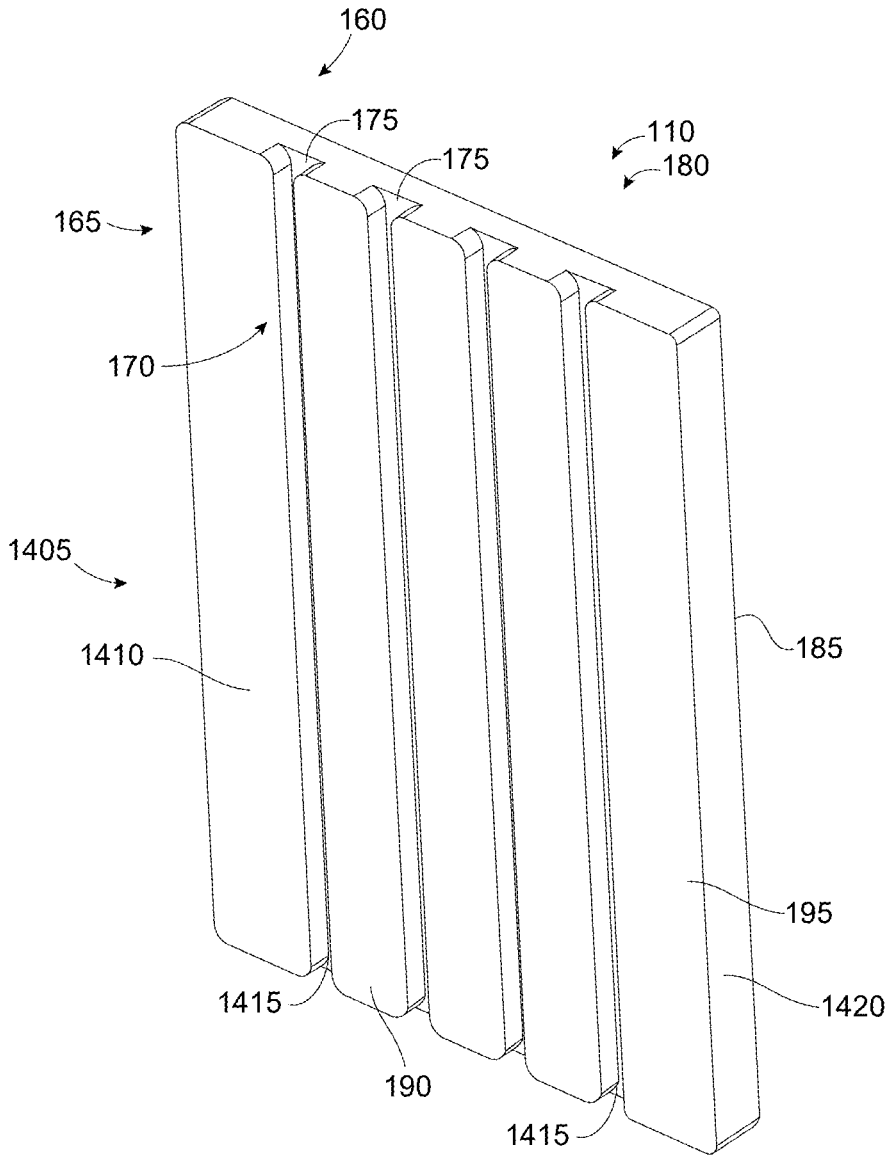
FIG. 14 is a schematic front perspective view of another version of a cooling member for use with the cooling system of the invention.

FIG. 14 shows another version of a cooling member 110 that can be used with the cooling system 100 of the invention and is insertable into the interior space 125 of a cooling panel body 120. The cooling member 110 of FIG. 14 includes a cooling member body 1405, which can be a rigid or semirigid body, that has an interior containing a cooling medium, such as water. The cooling member body 1405 can be made of any suitable material that is preferably lightweight and freezer-safe, such as HDPE or other thermoformed plastic. When the cooling medium is chilled, such as by being frozen by storing the entire cooling member body 1405 in a freezer, the walls of the cooling member body 1405 become chilled. In this version the cooling member body 1405 has an exterior surface 1410 with one or more cooling member body channels 1415 formed thereinto. The cooling member body channels 1415 thus form the airflow channels 175 of the airflow channeling system 170. The cooling member body channels 1415 thin and/or constrict the flow of air in the airflow pathway 200 when the cooling member 110 is inserted into the cooling panel body 120. In addition, the air flowing through the cooling member body channels 1415 contacts multiple surfaces that are chilled, such as the bottom and sidewalls of the channels. In the version shown, the interior of the cooling member body 1405 is a single compartment 195. Alternatively, individual compartment, such as individual vertical compartments, can be provided. Optionally, an opening into the interior of the cooling member body 1405 can be provided to allow the cooling medium to be replaced and/or to allow ice water or the like to be filled into the cooling member body 1405 for instant cooling.

In another version, the cooling member 110 can be permanently affixed within the interior space 125 of the panel body 120. With this version, the cooling medium within the one or more compartments 195 can be cooled or frozen by placing the entire cooling panel 105 and/or cooling system 100 in the freezer or the like. Alternatively, the permanently affixed cooling member 110 can have a one or more refillable compartments 195 into which a cold cooling medium can be filled prior to use of the cooling panel 105.

Figure 15:
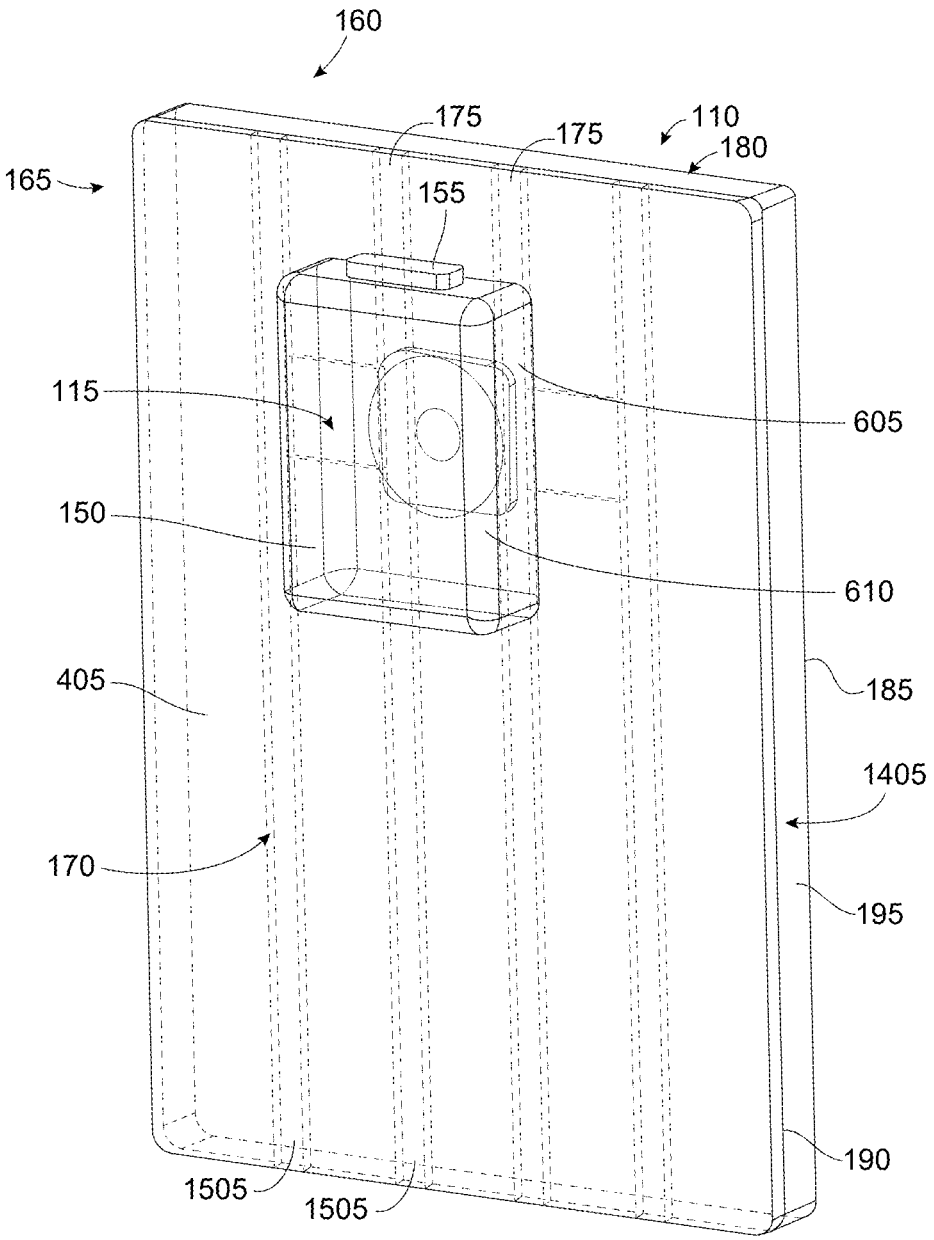
FIG. 15 is a schematic front perspective view of another version of a cooling member and insulation layer for use with the cooling system of the invention.

FIG. 15 shows another version of a cooling member having a cooling member body 1405 as in FIG. 14. In FIG. 15, the cooling panel body 120 is not shown for clarity. In the version of FIG. 15, the cooling member body 1405 does not have cooling member body channels 1415. Instead, an insulation layer 405 has insulation layer channels 1505 formed thereinto. The insulation layer channels 1505 are shown in phantom in FIG. 15 because the channels are on the side of the insulation layer 405 that faces the cooling member 110, and the insulation layer channels 1505 thus form the airflow channels 175 of the airflow channeling system 170. The insulation layer channels 1505 thin and/or constrict the air flow and expose the air flow to the cooling member 110 on at least one surface of the insulation layer channel 1505 so the cooling member 110 chills the air flowing through the insulation layer channels 1505.

Figure 16:
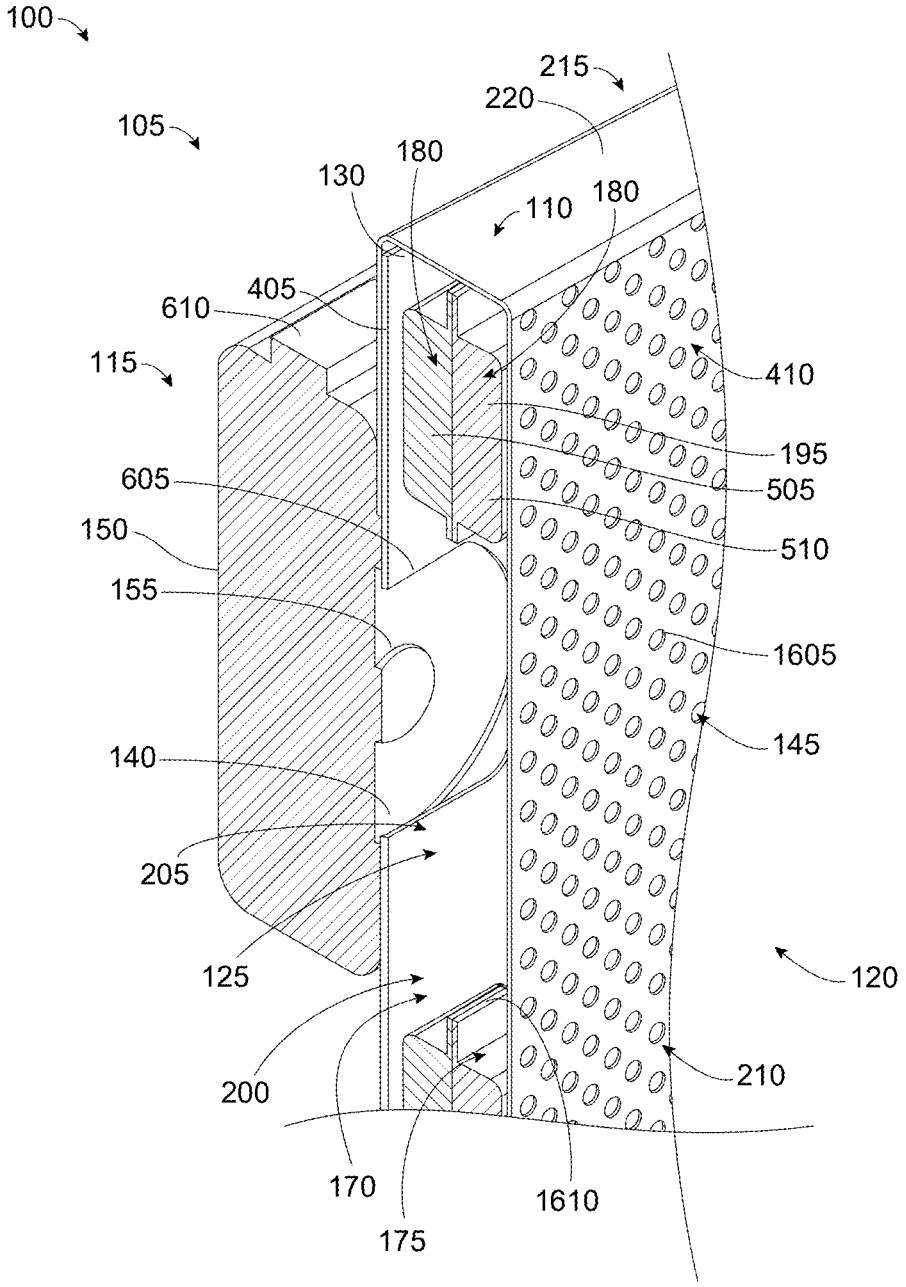
FIG. 16 is a schematic rear partially sectional perspective view of a portion of another version of a cooling system of the invention.
Figure 17:
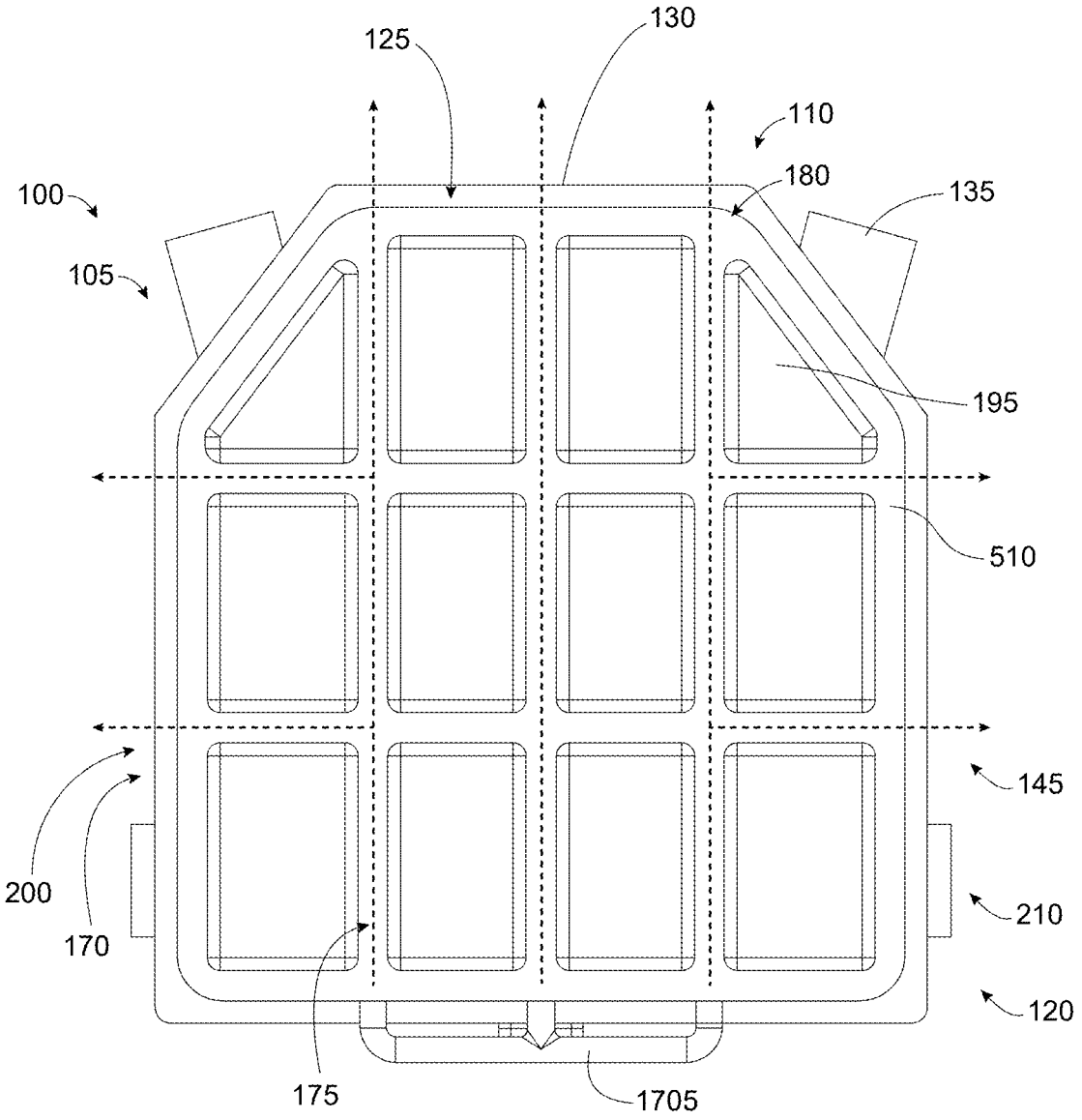
FIG. 17 is a schematic rear view of another version of a cooling system of the invention with portions removed for clarity.

FIGS. 16 and 17 show versions of a cooling system 100 according to the invention that operates by using the fan member 115 to blow environmental air into the cooling panel body 120 and emitting cool air from the cooling panel body 120. In this version, the panel air inlet is positioned in proximity to the fan air outlet 155. In the version of FIG. 16, air flows from the fan member 115 through the airflow pathway 200 in the cooling panel 105 and exits the cooling panel through one or more panel air outlets 145, which in the version of FIG. 16 are one or more openings 1605 or perforations in the rear wall 122 of the panel body 120. In the particular version of FIG. 16, the cooling member 110 comprises a front cooling sheet 505 and a rear cooling sheet 510 and an opening 1610 is provided in the sheets to allow air to pass to the rear of the cooling panel body 120. In the version of FIG. 17, in place of the opening 1610 through the front sheet 505 and the rear sheet 510, a conduit system 1705 serves as a portion of the airflow pathway 200 and transports the air to the rear sheet 510 so that the air can pass through airflow channels 175 in the cooling member 110. As can also be seen in the version of FIG. 17 the panel air outlets 145 can be in the sidewall 123 of the cool panel body 120 and/or the air can circle around to exit from the rear wall 122. FIG. 17 is a rear view with the rear wall 122 removed for clarity.

The one or more cooling panels 105 of the cooling system 100 can be used as described above, such as in a cooling vest 705 and/or can be separately useable. For example, the one or more cooling panels 105 can be separated from the cooling vest 705 and used on their own as a portable cooling system or inserted into or installed on another device or structure. For example, a cooling panel 105 can be inserted into a different type of cooling vest 705, such as a backpack 1800, as shown in FIG. 18, or draped over a chair 1900 as shown in FIG. 19.

Figure 18:
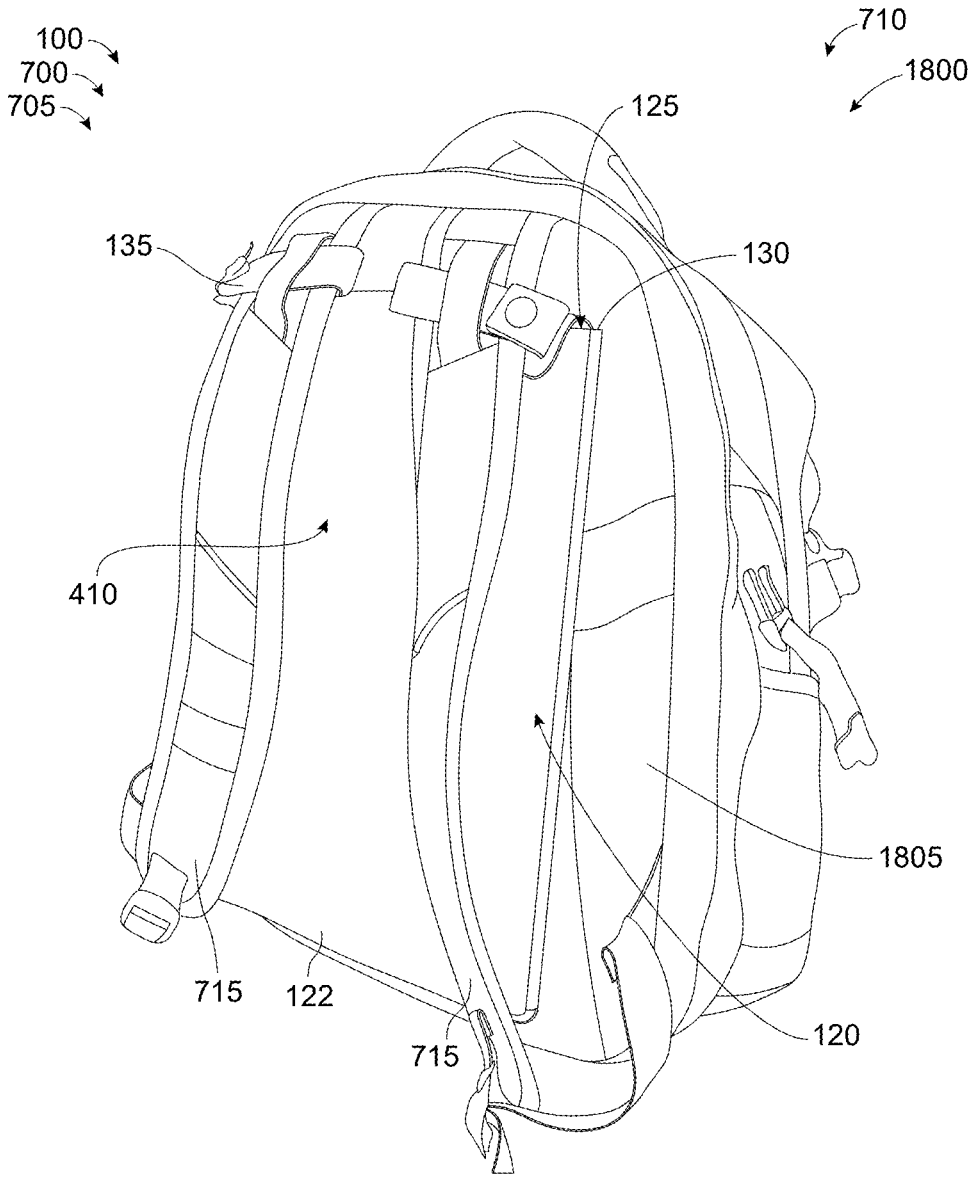
FIG. 18 is a schematic front perspective view of another version of a cooling system of the invention.
Figure 19:
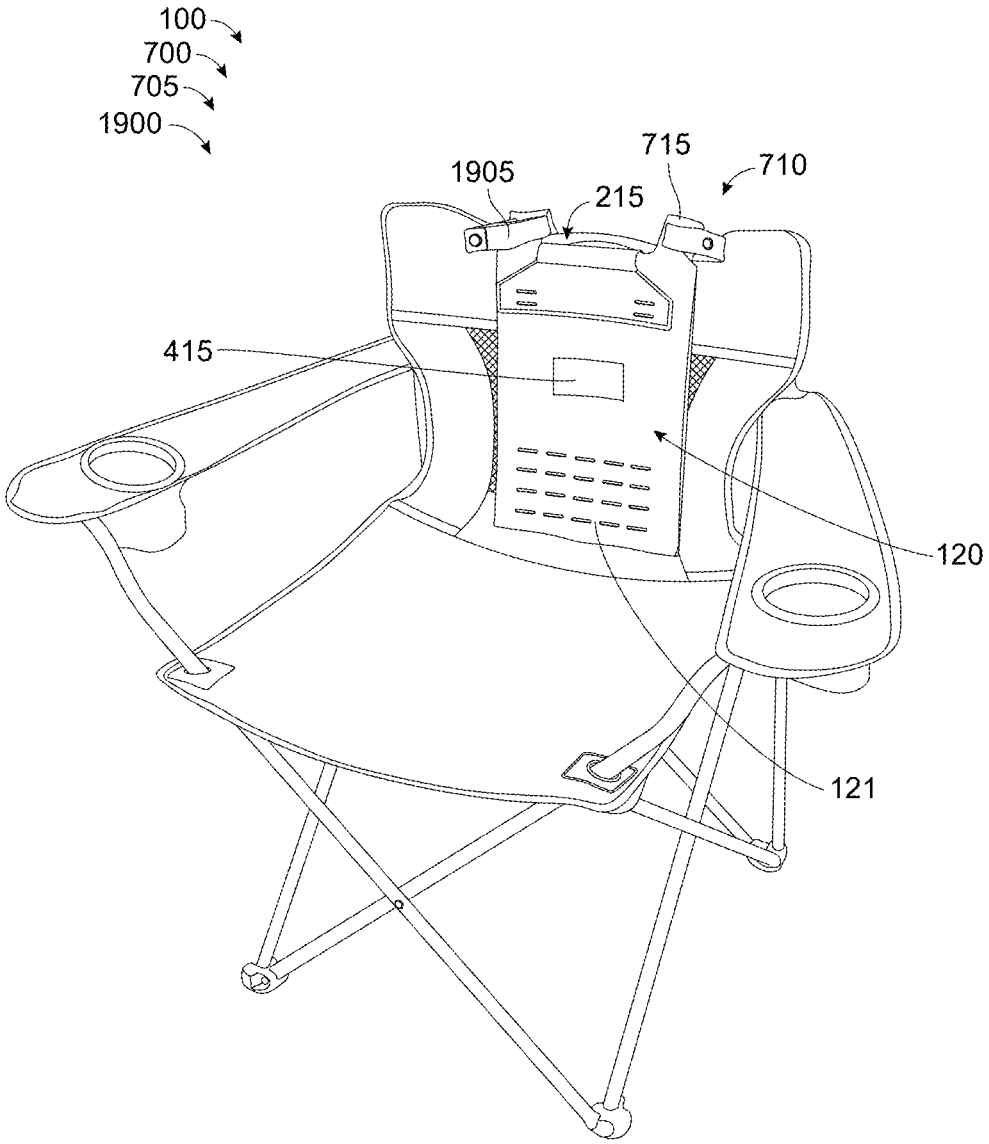
FIG. 19 is a schematic front perspective view of another version of a cooling system of the invention.

FIG. 18 shows another version of a cooling system 100 of the invention in which the cooling system 100 is a wearable cooling system 700 in the form of a wearable garment, such as a cooling vest 705 in the form of a backpack 1800. In the version of FIG. 18, the cooling panel body 120 is in the form of a backpack body 1805. The backpack body 1805 can have an interior space 125 as described above in the form of a pocket or the like in the backpack body 1805. Alternatively, the backpack body 1805 can include a pocket or the like into which a cooling panel 105 as described herein can be removed from a different type of cooling vest 705 and inserted into the backpack 1800. As can be seen, the cooling panel 105 may also be secured to the shoulder straps of the backpack 1800 with straps or buckles such that it stays in place. In this way the cooling panel 105 of the cooling system 100 can be used modularly and can be inserted and/or used with different types of wearable garments or other devices. In the specific version shown in FIG. 18, the cooling panel is used to cool by conduction. However, the backpack body 1805 can also be modified to allow for convection cooling as well.

In one version, the cooling system 100 in the form of a cooling vest 705 can be used when not being worn by a wearer. For example, as shown in FIG. 19, the cooling system 100 in the form of a wearable vest 705 can be doffed and placed over a chair 1900, such as by being draped over the back 1905 of a chair 1900. This allows the cooling system 100 to cool anyone sitting in the chair 1900 by conduction cooling, as shown in the version of FIG. 19, or by convection cooling with cool air being directed toward the individual sitting in the chair. In the version shown, the shoulder straps 715 of the supporting system 710 are used to support the cooling panels 105 on the chair 1900. The shoulder straps 715 can be adjustable in length and shortened for the purpose. Alternatively, a separate support system 710 for the chair 1900 can be provide, such as a pocket or the like in the chair 1900.

Figure 20A:
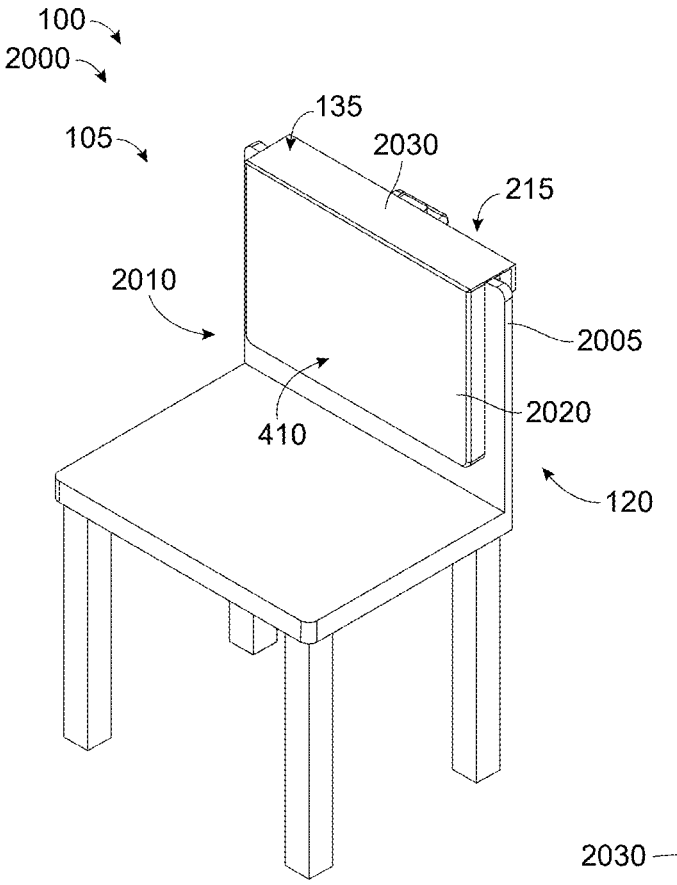
FIG. 20A is a schematic front perspective view of another version of a cooling system of the invention.
Figure 20B:
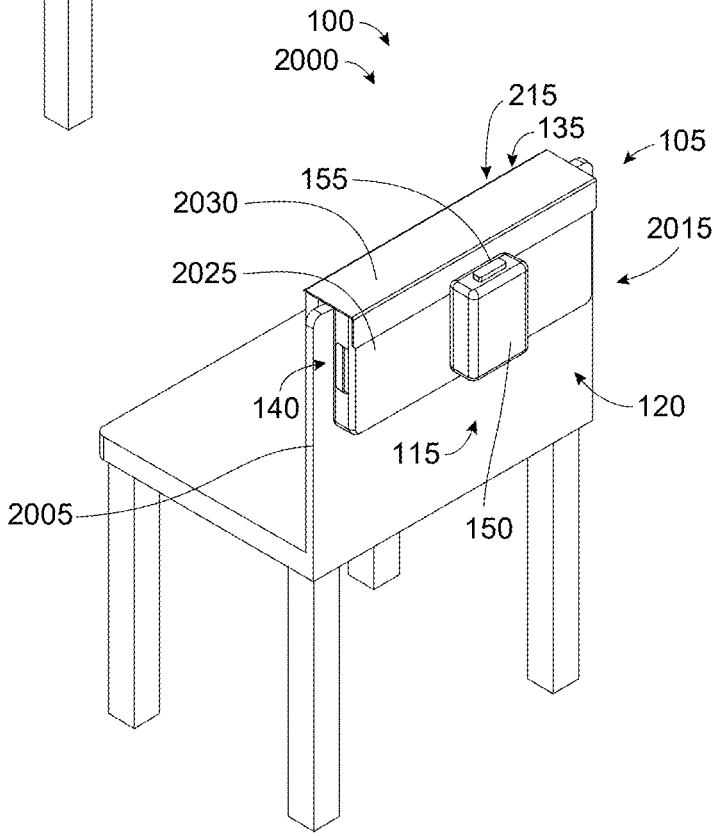
FIG. 20B is a schematic rear perspective view of the cooling system of FIG. 20A.
Figure 21:
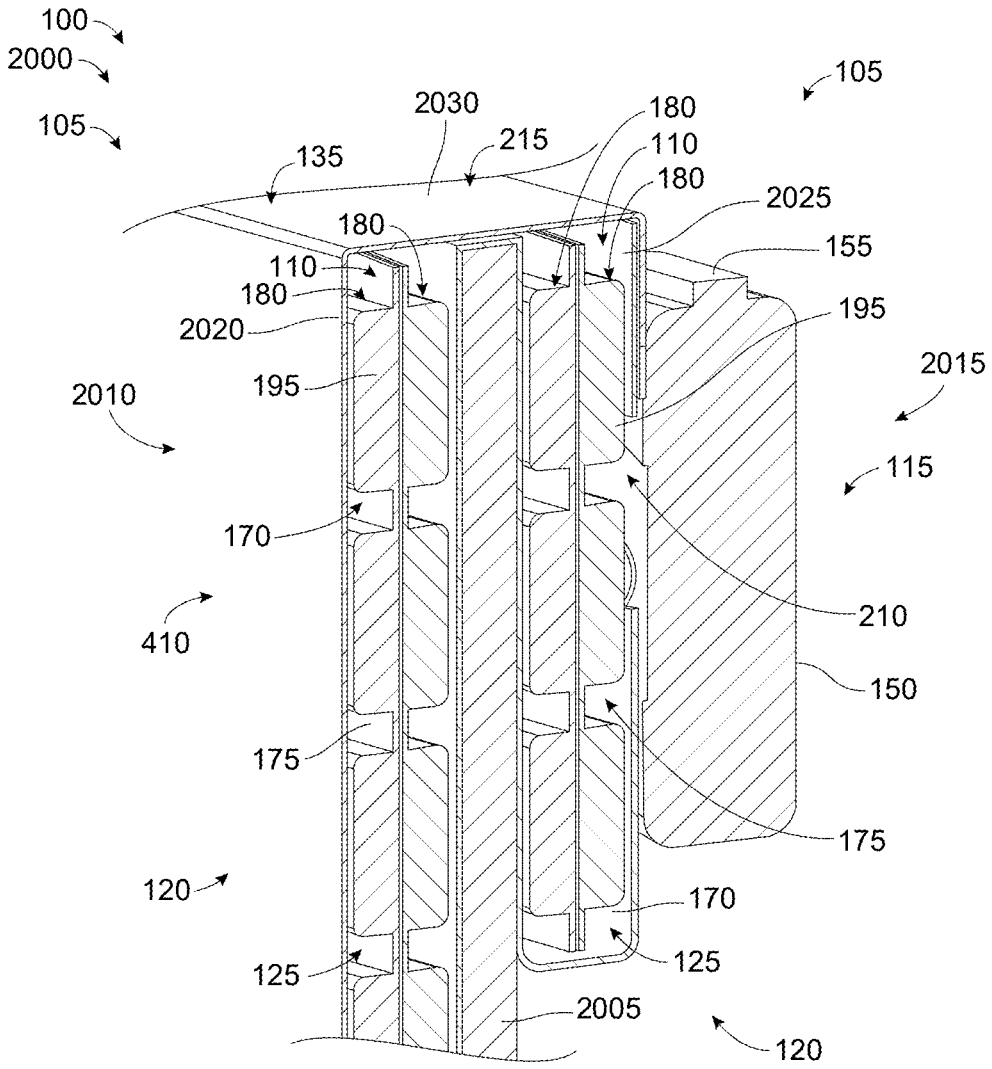
FIG. 21 is a schematic front partially sectional perspective view of the cooling system of FIG. 20A.

In another version, such as shown in FIGS. 20A and 20B, the cooling system 100 can be built into a structure, such as a cooling system chair 2000. The cooling system chair 2000 has a chair back 2005 with a front side 2010 and a rear side 2015. A cooling panel 105 on the front side 2010 can provide conduction cooling and/or a cooling panel 105 on the rear side 2015 can provide convection cooling. In this regard, the chair back 2005 can serve as the panel body 120 or can be a pocket or receptacle for receiving one or more cooling panels 105. For example, the cooling system chair 2000 can have a cooling panel body 120 in the form of a front receptacle 2020 that operates in similar manner to the front cooling panel 905 of the cooling vest 705 of FIG. 9 and can a cooling panel body 120 in the form of a rear receptable 2025 that operates in similar manner to the rear cooling panel 910. The front receptacle 2015 and rear receptacle 2020 can be connected by a flap 2030 that extends across the top of the chair back 2005. The flap 2030 can be openable to allow access to the receptacles. FIG. 21 shows a partially sectional view of the cooling system 100 of FIGS. 20A and 20B. The cooling panel 105 on the front side 2010 and the cooling panel 105 on the rear side 2015 can be differently sized and shaped from one another, as shown in FIGS. 20A, 20B, and 21 since the panels are designed for different purposes, or they can be the same or similar.

The cooling system 100 of the invention thus provides a one or more cooling panels 105 that can be worn as a wearable cooling vest 705 with integrated air flow channels 175 that can selectively be used to provide either conduction cooling, convection cooling, or both. While the combination of the possibility for conduction cooling and convection cooling is a particularly advantageous part of the cooling system 100 of the invention, the cooling system 100 also offers improvement with regard to each type of cooling alone. For example, traditional ice vests that cool by conduction typically feel too cold on the wearer because the interface against the skin is nearly the same temperature as ice. The cooling system 100 of the invention allows for the selection of materials and placements of components in a manner that the interface can be tailored as desired, and the interface temperature can be increased or decreased to improve comfort. Also, for the convection cooling, the cooling system 100 of the invention provides the blowing of chilled air rather than environmental air and does so without the need for expensive and weighty cooling equipment and power sources.

While various versions of the cooling system 100 have been described and exemplified, other versions and variations are also envisioned. For example, the fan member 115 can be positioned at the panel air inlet 140 and used to blow air through the cooling panel body 120 instead of drawing air in through the cooling panel body 120 in any of the versions described. Also, the cooling member 110 can involve circulating water that is passed over a heat sink to drop air temperature for the airflow. A heat sink could also be attached to the one or more cooling sheets 180 so that the airflow is restricted to a smaller area.

Although the present invention has been described in considerable detail with regard to certain preferred versions thereof, other versions are possible, and alterations, permutations and equivalents of the versions shown will become apparent to those skilled in the art upon a reading of the specification and study of the drawings. For example, the cooperating components may be reversed or provided in additional or fewer number, and all directional limitations, such as up and down and the like, can be switched, reversed, or changed as long as doing so is not prohibited by the language herein with regard to a particular version of the invention. Like numerals represent like parts from figure to figure. When the same reference number has been used in multiple figures, the discussion associated with that reference number in one figure is intended to be applicable to the additional figure(s) in which it is used, so long as doing so is not prohibited by explicit language with reference to one of the figures. Also, the various features of the versions herein can be combined in various ways to provide additional versions of the present invention. Furthermore, certain terminology has been used for the purposes of descriptive clarity, and not to limit the present invention. Throughout this specification and any claims appended hereto, unless the context makes it clear otherwise, the term "comprise" and its variations such as "comprises" and "comprising" should be understood to imply the inclusion of a stated element, limitation, or step but not the exclusion of any other elements, limitations, or steps. Throughout this specification and any claims appended hereto, unless the context makes it clear otherwise, the term "consisting of" and "consisting essentially of" should be understood to imply the inclusion of a stated element, limitation, or step and the exclusion of any other elements, limitations, or steps or the exclusion of any other essential elements, limitations, or steps, respectively. Throughout the specification, any discussion of a combination of elements, limitations, or steps should be understood to include (i) each element, limitation, or step of the combination alone, (ii) each element, limitation, or step of the combination with any one or more other element, limitation, or step of the combination, (iii) an inclusion of additional elements, limitations, or steps (i.e. the combination may comprise one or more additional elements, limitations, or steps), and/or (iv) an exclusion of additional elements, limitations, or steps or an exclusion of essential additional elements, limitations, or steps (i.e. the combination may consist of or consist essentially of the disclosed combination or parts of the combination). All numerical values, unless otherwise made clear in the disclosure or prosecution, include either the exact value or approximations in the vicinity of the stated numerical values, such as for example about +/−ten percent or as would be recognized by a person or ordinary skill in the art in the disclosed context. The same is true for the use of the terms such as about, substantially, and the like. Also, for any numerical ranges given, unless otherwise made clear in the disclosure, during prosecution, or by being explicitly set forth in a claim, the ranges include either the exact range or approximations in the vicinity of the values at one or both of the ends of the range. When multiple ranges are provided, the disclosed ranges are intended to include any combinations of ends of the ranges with one another and to include zero and infinity as possible ends of the ranges. Therefore, any appended or later filed claims should not be limited to the description of the preferred versions contained herein and should include all such alterations, permutations, and equivalents as fall within the true spirit and scope of the present invention.

What is claimed is:

1. A cooling vest for cooling a wearer, the cooling vest comprising:

a cooling panel, the cooling panel comprising:

a cooling panel body having a front wall, a rear wall, and an interior space between the front wall and the rear wall, a cooling member positionable within the interior space of the cooling panel body, the cooling member comprising a cooling sheet having a rear facing side and a front facing side, and a fan member positionable on the cooling panel body; and a supporting system adapted to support the cooling panel in proximity to the wearer's front or rear torso, wherein the cooling panel includes a conduction surface adapted to directly or indirectly contact the wearer, wherein both the cooling sheet rear facing side and the cooling sheet front facing side are cool in operation, wherein the conduction surface is cooled by the cooling member in the interior space, and wherein the fan member can blow air chilled by the cooling sheet towards the wearer in order to provide convection cooling.

2. A cooling vest according to claim 1 wherein the cooling sheet is removably insertable into the interior space so that it can be chilled prior to insertion.

3. A cooling vest according to claim 1 wherein the cooling panel body comprises a panel air inlet, a panel air outlet, and an airflow pathway between the panel air inlet and the panel air outlet, wherein air in the airflow pathway is chilled by the cooling sheet in the interior space, and wherein the fan member receives chilled air from the panel air outlet.

4. A cooling vest according to claim 3 wherein the airflow pathway comprises an airflow channeling system comprising one or more channels that direct air from the panel air inlet to the panel air outlet.

5. A cooling vest according to claim 4 wherein the airflow channel system comprises a plurality of airflow channels that allow flowing air to contact the cooling sheet and that thin, constrict, obstruct, or increase the contact surface area of air flowing from the panel air inlet to the panel air outlet.

6. A cooling vest according to claim 4 wherein the airflow channeling system creates a tortuous path for air flowing from the panel air inlet to the panel air outlet.

7. A cooling vest according to claim 1 wherein the cooling panel body comprises a panel air inlet, a panel air outlet, and an airflow pathway between the panel air inlet and the panel air outlet, wherein air in the airflow pathway is chilled by the cooling sheet in the interior space, and wherein the fan member blows air into the panel air inlet so that chilled air from the panel air outlet blows towards the wearer.

8. A cooling vest according to claim 1 wherein the conduction surface is the rear wall of the cooling panel body, and wherein the fan member is positionable on the front wall of the cooling panel body.

9. A cooling vest according to claim 1 wherein the fan member is removeable so the cooling panel can be used only for conduction cooling.

10. A cooling vest according to claim 1 wherein the supporting system comprises one or more shoulder straps connectable to the cooling panel and adapted to extend across the wearer's shoulders.

11. A cooling vest according to claim 1 wherein the cooling panel is a first cooling panel and wherein the cooling vest further comprises a second cooling panel, the first cooling panel being positionable in proximity to the wearer's front torso and the second cooling panel being positionable in proximity to the wearer's rear torso by the supporting system.

12. A cooling vest according to claim 11 wherein the second cooling panel comprises a second cooling panel body having a front wall, a rear wall, and an interior space between the front wall and the rear wall, and a cooling member removably insertable into the interior space of the second panel body.

13. A cooling vest according to claim 12 wherein the second cooling panel comprises a second fan member positionable on the second cooling panel body.

14. A cooling vest for cooling a wearer, the cooling vest comprising:

a cooling panel, the cooling panel comprising:

a cooling panel body having a front wall, a rear wall, and an interior space between the front wall and the rear wall, a cooling member positionable within the interior space of the cooling panel body, and a fan member positionable on the cooling panel body; and a supporting system adapted to support the cooling panel in proximity to the wearer's front or rear torso, wherein the cooling panel includes a conduction surface adapted to directly or indirectly contact the wearer, wherein the conduction surface is cooled by the cooling member in the interior space, and wherein the fan member can blow air towards the wearer, and wherein the cooling member comprises one or more cooling sheets, each cooling sheet comprising one or more compartments containing a cooling medium that can be chilled prior to insertion of the cooling member into the interior space.

15. A cooling vest according to claim 1 wherein the cooling panel further comprises an insulation layer between the cooling member and the front wall of the cooling panel body.

16. A cooling vest according to claim 1 wherein the cooling panel is separable from the supporting system and can be used modularly.

17. A cooling vest for cooling a wearer, the cooling vest comprising:

a cooling panel, the cooling panel comprising:

a cooling panel body having a front wall, a rear wall, and an interior space between the front wall and the rear wall, a cooling member positionable within the interior space of the cooling panel body, and a fan member positionable on the cooling panel body; and a supporting system adapted to support the cooling panel in proximity to the wearer's front or rear torso, wherein the cooling panel body comprises a panel air inlet, a panel air outlet, and an airflow pathway between the panel air inlet and the panel air outlet, wherein air in the airflow pathway is chilled by the cooling member in the interior space, and wherein the fan member receives chilled air from the panel air outlet and blows the chilled air towards the wearer.

18. A cooling vest according to claim 17 wherein the airflow pathway comprises an airflow channeling system comprising one or more channels that direct air from the panel air inlet to the panel air outlet, and wherein the one or more channels allow flowing air to contact the cooling member and that thin, constrict, obstruct, or increase the contact surface area of air flowing from the panel air inlet to the panel air outlet.

19. A method of cooling a wearer of a cooling vest, the method comprising:

providing a cooling vest comprising a cooling panel, the cooling panel comprising a cooling panel body having a front wall, a rear wall, and an interior space between the front wall and the rear wall;

providing a cooling member in the interior space of the cooling panel body;

positioning a fan member on the cooling panel body;

supporting the cooling panel in proximity to the wearer's front or rear torso;

cooling a conduction surface of the cooling panel body with the cooling member;

directly or indirectly contacting the wearer with the conduction surface of the cooling panel body to cool the wearer by conduction cooling;

cooling air in the interior space with the cooling member; and using the fan member to blow the air cooled in the interior space towards the wearer to cool the wearer by convection cooling.

20. A cooling vest according to claim 1 wherein the cooling sheet comprises one or more compartments containing a cooling medium that can be chilled prior to insertion of the cooling member into the interior space.

21. A cooling vest according to claim 1 wherein the cooling member comprises a plurality if cooling sheets.

22. A cooling vest according to claim 14 wherein the cooling medium comprises a substance that freezes at or below 32 degrees F.

* * * * *